US011138947B2

(12) United States Patent
Iwase et al.

(10) Patent No.: US 11,138,947 B2
(45) Date of Patent: Oct. 5, 2021

(54) SCANNING SIGNAL LINE DRIVE CIRCUIT AND DISPLAY DEVICE PROVIDED WITH SAME

(71) Applicant: SHARP KABUSHIKI KAISHA, Sakai (JP)

(72) Inventors: Yasuaki Iwase, Sakai (JP); Yohei Takeuchi, Sakai (JP); Takuya Watanabe, Sakai (JP); Akira Tagawa, Sakai (JP); Jun Nishimura, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/885,884

(22) Filed: May 28, 2020

(65) Prior Publication Data

US 2020/0394977 A1 Dec. 17, 2020

Related U.S. Application Data

(60) Provisional application No. 62/860,397, filed on Jun. 12, 2019.

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2310/0202* (2013.01); *G09G 2310/0286* (2013.01); *G09G 2310/06* (2013.01); *G09G 2310/08* (2013.01)

(58) Field of Classification Search
CPC ..... G09G 2310/0286; G09G 2310/061; G09G 2310/0202; G09G 2310/0264; G09G 2310/0267; G09G 2330/021; G09G 3/3677; G09G 2320/043; G09G 2310/0289; G09G 2310/0297; G09G 2310/0243; G09G 3/3266; G09G 3/3648
See application file for complete search history.

(56) References Cited

U.S. PATENT DOCUMENTS

| | | | | |
|---|---|---|---|---|
| 9,153,341 | B2 * | 10/2015 | Umezaki | G11C 19/184 |
| 9,583,065 | B2 * | 2/2017 | Chung | G09G 3/3677 |
| 10,296,121 | B2 * | 5/2019 | Iwase | G11C 19/28 |
| 10,685,616 | B2 * | 6/2020 | Huang | G09G 3/3266 |

(Continued)

FOREIGN PATENT DOCUMENTS

| | | |
|---|---|---|
| WO | 2011/080936 A1 | 7/2011 |
| WO | 2018/193912 A1 | 10/2018 |

*Primary Examiner* — Dismery Mercedes
(74) *Attorney, Agent, or Firm* — ScienBiziP, P.C.

(57) ABSTRACT

A unit circuit that constitutes a shift register includes a gate output lowering transistor (T01) whose source terminal is supplied with a second gate low voltage (Vgl2) and a gate output reset transistor (T03) Whose source terminal is supplied with a first gate low voltage (Vgl1), as constituent elements associated with the lowering of gate output. At the time of lowering the gate output, the gate output lowering transistor (T01) is made to be in an on state, and thereafter the gate output reset transistor (T03) is made to be in the on state. In this case, the gate terminal of the gate output reset transistor (T03) is supplied with a scanning signal or a signal having a waveform equivalent to that of the scanning signal outputted from the unit circuit in a subsequent stage.

10 Claims, 21 Drawing Sheets

(56) References Cited

U.S. PATENT DOCUMENTS

| | | | | |
|---|---|---|---|---|
| 10,885,822 | B2 * | 1/2021 | Hu | G11C 29/021 |
| 10,923,064 | B2 * | 2/2021 | Takeuchi | G09G 3/3677 |
| 2012/0146969 | A1 * | 6/2012 | Sakamoto | G02F 1/13454 345/204 |
| 2012/0242630 | A1 | 9/2012 | Ohara | |
| 2012/0249502 | A1 * | 10/2012 | Takahashi | H03K 19/01728 345/205 |
| 2015/0269900 | A1 * | 9/2015 | Iwamoto | G09G 3/3688 345/100 |
| 2016/0372068 | A1 * | 12/2016 | Yamamoto | G11C 19/28 |
| 2017/0323612 | A1 * | 11/2017 | Yamamoto | G11C 19/00 |
| 2018/0308444 | A1 * | 10/2018 | Sueki | G11C 19/28 |
| 2019/0108810 | A1 * | 4/2019 | Iwase | G06F 3/0412 |
| 2020/0243032 | A1 * | 7/2020 | Gu | G11C 7/02 |

* cited by examiner

--PRIOR ART--

--PRIOR ART--

SCANNING SIGNAL LINE DRIVE CIRCUIT AND DISPLAY DEVICE PROVIDED WITH SAME

BACKGROUND OF INVENTION

Field of Invention

The following disclosure relates to a display device, and more particularly relates to a scanning signal line drive circuit for driving a gate bus line (scanning signal line) disposed in a display portion of the display device.

Description of Related Art

Conventionally, a liquid crystal display device is known that is provided with a display portion including a plurality of source bus lines (video signal lines) and a plurality of gate bus lines (scanning signal lines). In such a liquid crystal display device, a pixel forming section that forms a pixel is provided at an intersection between a source bus line and a gate bus line. Each pixel forming section includes a thin film transistor (pixel TFT) serving as a switching element with a gate terminal connected to a gate bus line routed through the corresponding intersection and a source terminal connected to a source bus line routed through the intersection, a pixel capacitance configured to hold a pixel voltage value, and the like. The liquid crystal display device is also provided with a gate driver (scanning signal line drive circuit) configured to drive the gate bus lines and a source driver (video signal line drive circuit)) configured to drive the source bus lines.

A video signal indicative of a pixel voltage value is transmitted through the source bus lines. However, each source bus line is unable to transmit video signals indicative of pixel voltage values for a plurality of rows at a time (at the same time). Because of this, video signals are sequentially written (charged) into the pixel capacitances in a plurality of pixel forming sections provided in the display portion, on a row-by-row basis. Thus, the gate driver is constituted of a shift register with a plurality of stages to allow the plurality of gate bus s to be sequentially selected at predetermined time intervals. Then, active scanning signals (scanning signals with a voltage level that brings the pixel TFT to an on state) are sequentially output from each stage of the shift register to allow the video signals to be sequentially written into the pixel capacitances on a row-by-row basis as described above. A circuit constituting each of the stages of the shift register is referred herein to as a "unit circuit".

Incidentally, in such a liquid crystal display device, the gate driver has been mounted as an integrated circuit (IC) chip on a peripheral portion of a substrate constituting a liquid crystal panel in many cases. However, in recent years, the number of cases in which the gate driver is directly formed on a substrate has been gradually increasing, Such a gate driver is referred to as a "monolithic gate driver" or the like.

With regard to a monolithic gate driver, each stage (each unit circuit) of the shift register is provided with a transistor (hereinafter referred to as a "gate output lowering transistor") for lowering a gate output (a voltage of a scanning signal outputted from the gate driver). In general, in the gate output lowering transistor, a gate terminal is supplied with a reset signal, a drain terminal is connected to a gate bus line, and a source terminal is supplied with a gate low voltage, which is a low level DC power supply voltage. This gate low voltage has a voltage level that brings a pixel TUFT to an off state (in other words, a voltage level that brings the gate bus line to a non-select state). In the configuration described above, when the gate output is to be lowered, the reset signal is set to a high level, so that the gate output lowering transistor is brought to an on state. With this, a scanning signal is changed from a high level to a low level. Note that, although the description has been given here on the assumption that n-channel transistors are used, a transistor for raising the gate output is provided in each stage of the shift register in a case of using p-channel transistors instead.

As described above, the gate output is lowered by using the gate output lowering transistor in the monolithic gate driver, but as in a portion indicated by an arrow labeled with a reference symbol 90 in FIG. 20, a dull shape is generated in a waveform of the gate output in accordance with the magnitude of a gate load or the like. In a case where a source voltage (voltage of the video signal) is switched before the gate output is sufficiently lowered, a desired pixel voltage value is not written into the pixel capacitance. Accordingly, the switching of the source voltage is carried out after the gate output is sufficiently lowered. Note that in FIG. 20, a voltage level (of the scanning signal) that reliably brings the pixel TFT to an on state is represented by Vgh, and a voltage level (of the scanning signal) that reliably brings the pixel TFT to an off state is represented by Vgl. Incidentally, in recent years, higher definition of panels has been achieved. As a panel has higher definition, the length of one horizontal scan period becomes shorter. At this time, when a period of time required for lowering the gate output (hereinafter referred to as a "gate output lowering time") (a period of time indicated by an arrow labeled with a reference symbol 91 in FIG. 20) is long, a charging time of the pixel capacitance may not be sufficiently secured. As discussed above, the degree of resolution achievable depends on the gate output lowering time.

Thus, WO 2011/080936 pamphlet discloses a shift register having achieved a reduction in gate output lowering time by applying a high voltage to the gate terminal of a gate output lowering transistor to enhance the drive capability of the gate output lowering transistor.

However, according to the technique disclosed in WO 2011/080936 pamphlet, the gate output lowering transistor is considerably deteriorated because a high voltage is applied to the gate terminal of the gate output lowering transistor. Accordingly, the effect of the reduction in gate output lowering time by this technique is not sustained for a long time.

Thus, WO 2018/193912 pamphlet discloses a technique in which two kinds of gate low voltages (a first gate low voltage Vgl1 with a voltage level having been usually used for bringing a gate bus line GL to a non-select state, and a second gate low voltage Vgl2 with a voltage level lower than the voltage level of the first gate low voltage Vgl1) are prepared, and at the time of lowering the gate output, the voltage of the scanning signal is made to once drop to the voltage level of the second gate low voltage Vgl2 and thereafter is changed to the voltage level of the first gate low voltage Vgl1. According to this technique, the rate of change in the voltage of the scanning signal is greater than that of the technique of the past, so that the gate output lowering time is shorter than that of the past.

Incidentally, according to the configuration disclosed in WO 2018/193912 pamphlet, the second gate low voltage Vgl2 is supplied to the source terminal of the gate output lowering transistor described above, and the first gate low voltage Vgl1 supplied to the source terminal of a gate output stabilizing transistor serving as a transistor for maintaining the gate output at a low level during a regular action period (a period other than the period in which the gate bus line is set to the select state and the writing into the pixel capacitance is carried out). Then, at the end of each horizontal scan period, the gate output lowering transistor is first brought to the on state, and thereafter the gate output stabilizing transistor is brought to the on state. Here, the gate output stabilizing transistor is maintained in the on state for most of the period in which actions of the device are carried out. Because of this, as for the gate output stabilizing transistor, a gate bias time (a period of time during which a voltage for bringing the transistor to the on state is applied to the gate terminal of the transistor) is long, so that a threshold shift (change in threshold voltage) is large. Thus, the period of time required for the voltage of the scanning signal to change from the voltage level of the second gate low voltage Vgl2 to the voltage level of the first gate low voltage Vgl1 is significantly different between the initial time point of the device and the time after the long term use of the device. For example, at the initial time point, the voltage of the scanning signal changes as indicated by a thick solid line labeled with a reference symbol 92 in FIG. 21, while the voltage of the scanning signal changes, after the long term use of the device, as indicated by a thick dotted line labeled with a reference symbol 93 in FIG. 21. In a case where there exists such a difference between the initial time point of the device and the time after the long term use of the device, there arises a need to consider the influence of the above-mentioned difference on the pixel forming section described above.

SUMMARY OF INVENTION

Accordingly, an object of the following disclosure is to achieve a gate driver scanning signal line drive circuit) able to quickly change a voltage of a scanning signal to a desired level at the end of each horizontal scan period, regardless of the length of a term of use of the device.

(1) A scanning signal line drive circuit according to several embodiments of the present invention is a scanning signal line drive circuit that includes a shift register constituted of a plurality of unit circuits configured to act based on a plurality of clock signals, and that drives a plurality of scanning signal lines disposed in a display portion of a display device;

each unit circuit is supplied at least with a first non-select level voltage and a second non-select level voltage as non-select level voltages having a voltage level for bringing a scanning signal line to a non-select state;

each unit circuit includes, a first output node configured to output a first output signal to be supplied to a corresponding scanning signal line, a first output node reset transistor having a control terminal to be supplied with the first output signal or a signal having a waveform equivalent to a waveform of the first output signal outputted from a first output node of the unit circuit in a subsequent stage, a first conduction terminal connected to the first output node, and a second conduction terminal to be supplied with the first non-select level voltage, and a non-select control transistor having a control terminal, a first conduction terminal connected to the first output node, and a second conduction terminal to be supplied with the second non-select level voltage;

the plurality of unit circuits sequentially output, as the first output signal, a select level voltage having a voltage level for bringing the scanning signal line to a select state from the first output node;

a difference between the voltage level of the select level voltage and the voltage level of the second non-select level voltage is greater than a difference between the voltage level of the select level voltage and the voltage level of the first non-select level voltage; and in each unit circuit, when the corresponding scanning signal line is changed from the select state to the non-select state, the non-select control transistor is made to be in an on state and thereafter the first output node reset transistor is made to be in the on state.

According to this configuration, as constituent elements for changing the voltage of the scanning signal (the first output signal), which is output from the scanning signal line drive circuit, from the on level to the off level, each unit circuit includes the first output node reset transistor having the second conduction terminal to which the first non-select level voltage is supplied, and the non-select control transistor having the second conduction terminal to which the second non-select level voltage is supplied. Then, at the end of each horizontal scan period, in a row corresponding to the scanning signal line having been in the select state, the voltage of the scanning signal changes from the voltage level of the select level voltage to the voltage level of the second non-select level voltage and thereafter changes from the voltage level of the second non-select level voltage to the voltage level of the first non-select level voltage. Here, the control terminal of the first output node reset transistor is supplied with the first output signal or a signal having a waveform equivalent to that of the first output signal outputted from the unit circuit in a subsequent stage. That is, the duty ratio of a bias voltage applied to the control terminal of the first output node reset transistor is significantly small. Accordingly, the threshold shift of the first output node reset transistor is small, and thus, even after the long time use of the device, the voltage of the scanning signal changes from the voltage level of the second non-select level voltage to the voltage level of the first non-select level voltage in a relatively short time. As described above, such a scanning signal line drive circuit is achieved that is able to quickly change the voltage of a scanning signal to a desired level at the end of each horizontal scan period, regardless of the length of the term of use of the device.

(2) A scanning signal line drive circuit according to several embodiments of the present invention includes the configuration of (1) described above, wherein each unit circuit further includes a second output node configured to output a second output signal, for controlling action of another unit circuit, having a waveform equivalent to that of the first output signal, each unit circuit is supplied with the second output signal outputted from a second output node of the unit circuit positioned backward by P stages, as a first rest signal, each unit circuit is supplied with the second output signal outputted from a second output node of the unit circuit positioned backward by Q stages, as a second reset signal, the above-mentioned Q is greater than the above-mentioned P, the first rest signal is supplied to the control terminal of the non-select control transistor, and the second rest signal is supplied to the control terminal of the first output node reset transistor.

(3) A scanning signal line drive circuit according to several embodiments of the present invention includes the configuration of (2) described above, wherein each unit circuit is supplied with the second output signal outputted from a second output node of the unit circuit in a preceding stage, as a set signal, and each unit circuit further includes, a select control transistor having a control terminal, a first conduction terminal to be supplied with the select level voltage continuously or every predetermined period, and a second conduction terminal connected to the first output node, a first node connected to the control terminal of the select control transistor, a first node turn-on transistor for changing a potential of the first node toward an on level based on the set signal, and a first node turn-off transistor for changing the potential of the first node toward an off level based on the first reset signal.

(4) A scanning signal line drive circuit according to several embodiments of the present invention includes the configuration of (3) described above, wherein each unit circuit further includes an output control transistor having a control terminal connected to the first node, a first conduction terminal to be supplied with one of the plurality of clock signals, and a second conduction terminal connected to the second output node, the first conduction terminal of the select control transistor is supplied with the same clock signal as the clock signal supplied to the first conduction terminal of the output control transistor among the plurality of clock signals, and a voltage level of the plurality of clock signals varies between the voltage level the select level voltage and the voltage level of the non-select level voltage.

(5) A scanning signal line drive circuit according to several embodiments of the present invention includes the configuration of (3) described above, wherein a DC voltage is supplied, as the select voltage, to the first conduction terminal of the select control transistor.

(6) A scanning signal line drive circuit according to several embodiments of the present invention includes the configuration of (3) or (5) described above, wherein each unit circuit further includes, an output control transistor having a control terminal connected to the first node, a first conduction terminal to be supplied with one of the plurality of clock signals, and a second conduction terminal connected to the second output node, a non-output control transistor having a control terminal to be supplied with the first reset signal, a first conduction terminal connected to the second output node, and a second conduction terminal to be supplied with the non-select level voltage, a first node stabilizing transistor having a control terminal, a first conduction terminal connected to the first node, and a second conduction terminal to be supplied with the non-select level voltage, a second node connected to the control terminal of the first node stabilizing transistor, a second node turn-on transistor for maintaining a potential of the second node at an on level during a period in which a potential of the first node has to be maintained at an off level, a second node turn-off transistor having a control terminal connected to the first node, a first conduction terminal connected to the second node, and a second conduction terminal to be supplied with the non-select level voltage, a second output node stabilizing transistor having a control terminal connected to the second node, a first conduction terminal connected to the second output node, and a second conduction terminal to be supplied with the non-select level voltage, and a first output node stabilizing transistor having a control terminal connected to the second node, a first conduction terminal connected to the first output node, and a second conduction terminal to be supplied with the first non-select level voltage, and the first node turn-off transistor includes a control terminal be supplied with the first reset signal, a first conduction terminal connected to the first node, and a second conduction terminal to be supplied with the non-select level voltage.

(7) A scanning signal line drive circuit according to several embodiments of the present invention includes the configuration of (1) or (2) described above, wherein each unit circuit further includes, a select control transistor having a control terminal, a first conduction terminal to be supplied with the select level voltage continuously or every predetermined period, and a second conduction terminal connected to the first output node, a first node connected to the control terminal of the select control transistor, a first node stabilizing transistor having a control terminal, a first conduction terminal connected to the first node, and a second conduction terminal to be supplied with the non-select level voltage, a second node connected to the control terminal of the first node stabilizing transistor, a second node turn-on transistor for maintaining a potential of the second node at an on level during a period in which a potential of the first node has to be maintained at an off level, and a first output node stabilizing transistor having a control terminal connected to the second node, a first conduction terminal connected to the first output node, and a second conduction terminal to be supplied with the first non-select level voltage.

(8) A scanning signal line drive circuit according to several embodiments of the present invention includes any one of the configurations of (1) to (7) described above, wherein the first output node reset transistor and the non-select control transistor are n-channel thin film transistors, the voltage level of the select level voltage is higher than the voltage level of the first non-select level voltage, and the voltage level of the first non-select level voltage is higher than the voltage level of the second non-select level voltage.

(9) A display device according to several embodiments of the present invention includes the scanning signal line drive circuit of any one of the configurations (1) to (8) described above.

These and other objects, features, aspects, and effects of the present invention will become more apparent from the following detailed description of the invention with reference to the accompanying drawings.

DESCRIPTION OF PREFERRED EMBODIMENTS

0. Introduction

Figure 1:
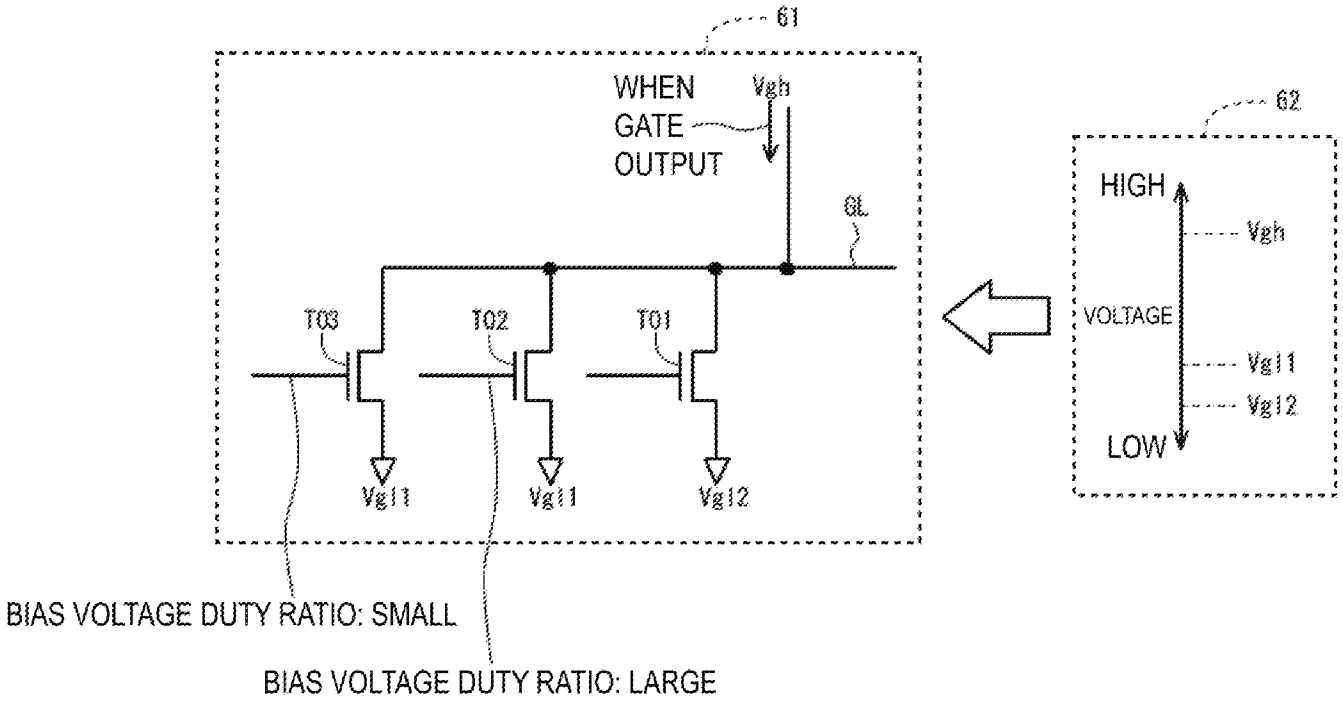
FIG. 1 is a diagram for describing features common to all embodiments.

Before describing each embodiment, items common to all embodiments (including modification examples) will be described with reference to FIG. 1. FIG. 1 illustrates a configuration associated with lowering a gate output of one unit circuit included in a shift register constituting a gate driver inside dotted lines labeled with a reference symbol 61. In the unit circuit, as constituent elements associated with the lowering of the gate output, there are provided a gate output lowering transistor T01, a gate output stabilizing transistor T02, and a gate output reset transistor T03 for quickly changing a voltage of a scanning signal from a voltage level of a second gate low voltage Vgl2 to a voltage of a first gate low voltage Vgl1. A drain terminal of each of the gate output love g transistor T01, the gate output stabilizing transistor T02, and the gate output reset transistor T03 is connected to a corresponding gate bus line GL. In addition, as low level DC power supply voltages for controlling actions of the gate driver, there are prepared the first gate low voltage Vgl1 with a voltage level having been used for bringing a pixel TFT to an off state (bringing the gate bus line GL to a non-select state) and the second gate low voltage Vgl2 with a voltage level lower than the voltage level of the first gate low voltage Vgl1 (see the inside of dotted lines labeled with a reference symbol 62 in FIG. 1). Then, a source terminal of the gate output stabilizing transistor T02 and a source terminal of the gate output reset transistor 103 are supplied with the first gate low voltage Vgl1, and a source terminal of the gate output lowering transistor T01 is supplied with the second gate low voltage Vgl2. In the above-described configuration, when the gate output is lowered, the gate output lowering transistor T01 is first set to the on state, and thereafter the gate output stabilizing transistor T02 and the gate output reset transistor T03 are brought to the on state. With this, at the time of lowering the gate output, the voltage of the scanning signal once drops to the voltage level of the second gate low voltage Vgl2 and thereafter changes to the first gate low voltage Vgl1. Note that the duty ratio of a bias voltage applied to a gate terminal of the gate output stabilizing transistor T02 is large, but the duty ratio of a bias voltage applied to a gate terminal of the gate output reset transistor T03 is small.

Embodiments will be described based on the above-discussed points. In the description below, a gate terminal (gate electrode) of a thin film transistor corresponds to a control terminal, a drain terminal (drain electrode) of the thin film transistor corresponds to a first conduction terminal, and a source terminal (source electrode) of the thin film transistor corresponds to a second conduction terminal. Regarding the drain and the source, one of the drain and the source that has a higher potential is referred to as the drain in general. However, in the description herein, since one of the electrodes is defined as a drain and the other one is defined as a source, a source potential may be higher than a drain potential in some cases.

The voltage level of the first gate low voltage Vgl1 is also referred to as the "first low level", and the voltage level of the second gate low voltage Vgl2 is also referred to as the "second low level". Further, in the accompanying drawings (such as FIG. 8), a reference symbol Vgl1 is assigned to the same voltage level as the voltage level of the first gate low voltage, a reference symbol Vgl2 is assigned to the same voltage level as the voltage level of the second gate low voltage, and a reference symbol Vgh is assigned to the same voltage level as the voltage level of a gate high voltage to be explained later.

1. First Embodiment

1.1 General Configuration and Action Outline

Figure 2:
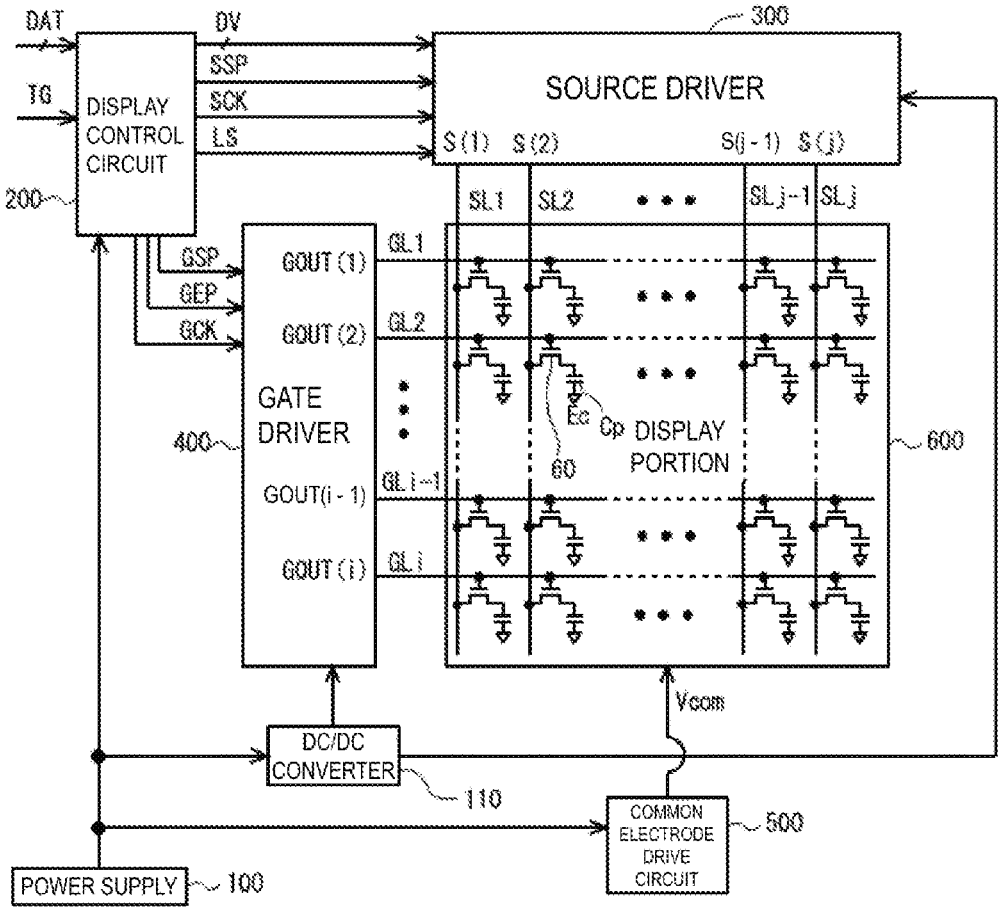
FIG. 2 is a block diagram illustrating a general configuration of an active-matrix liquid crystal display device according to a first embodiment.

FIG. 2 is a block diagram illustrating a general configuration of an active-matrix liquid crystal display device according to a first embodiment. As illustrated in FIG. 2, the liquid crystal display device includes a power supply 100, a DC/DC converter 110, a display control circuit 200, a source driver (video signal line drive circuit) 300, a gate driver (scanning signal line drive circuit) 400, a common electrode drive circuit 500, and a display portion 600. Note that in the present embodiment, the gate driver 400 and the display portion 600 are formed on the same substrate (a TFT substrate, which is one of two substrates constituting a liquid crystal panel). In other words, the gate driver 400 of the present embodiment is a monolithic gate driver.

In the display portion 600, there are formed a plurality of (j) source bus lines (video signal lines) SL1 to SLj, a plurality of (i) gate bus lines (scanning signal lines) GL1 to GLi, and a plurality of (i×j) pixel forming sections that are respectively provided corresponding to intersections between the plurality of source bus lines SL1 to SLj and the plurality of gate bus lines GL1 to GLi. The plurality of pixel forming sections are arranged in a matrix shape to form a pixel array. Each of the pixel forming sections includes a thin film transistor (TFT) 60 as a switching element with a gate terminal connected to a gate bus line routed through the corresponding intersection and a source terminal connected to a source bus line routed through the intersection, a pixel electrode connected to a drain terminal of the thin film transistor 60, a common electrode Ec as a counter electrode provided commonly in the plurality of pixel forming sections, and a liquid crystal layer provided commonly in the plurality of pixel forming sections and pinched between the pixel electrode and the common electrode Ec. A liquid crystal capacitance formed by the pixel electrode and the common electrode Ec constitutes a pixel capacitance Cp. Note that, normally, an auxiliary capacitance is provided in parallel with the liquid crystal capacitance to reliably hold the charge in the pixel capacitance Cp, but the auxiliary capacitance is not directly related to the subject matter of the present disclosure, and thus descriptions and illustrations thereof will be omitted. In the present embodiment, the thin film transistor 60 is an n-channel type.

Note that in the present embodiment, a thin film transistor (IGZO-TFT) including an oxide semiconductor layer containing an In—Ga—Zn—O-based semiconductor is employed for the thin film transistor 60 in the display unit 600. In addition, a thin film transistor (IGZO-TFT) including an oxide semiconductor layer containing an In—Ga—Zn—O-based semiconductor is also employed in a similar manner for a thin film transistor in the gate driver 400 (a thin film transistor included in each unit circuit 4 in a shift register 410 to be described below). However, various kinds of variations are applicable to the material of the semiconductor layer of the thin film transistor. For example, a thin film transistor using amorphous silicon in the semiconductor layer (a-Si TFT), a thin film transistor using microcrystalline silicon in the semiconductor layer, a thin film transistor using an oxide semiconductor in the semiconductor layer (oxide TFT), a thin film transistor using low-temperature polysilicon in the semiconductor layer (LTPS-TFT), and the like may also be employed.

The power supply 100 supplies a predetermined power supply voltage to the DC/DC converter 110, the display control circuit 200, and the common electrode drive circuit 500. The DC/DC converter 110 generates a DC voltage for enabling actions of the source driver 300 and the gate driver 400 from the power supply voltage thereof, and supplies the generated DC voltage to the source driver 300 and the gate driver 400. Note that the DC voltage supplied to the gate driver 400 includes a high level DC power supply voltage VDD, the first gate low voltage Vgl1, and a second gate low voltage Vgl2. The common electrode drive circuit 500 supplies a common electrode drive voltage Vcom to the common electrode Ec.

The display control circuit 200 receives an image signal DAT sent from the outside and a timing signal group TG such as a horizontal synchronization signal and a vertical synchronization signal, and outputs a digital video signal DV, a source start pulse signal SSP for controlling image display in the display portion 600, a source clock signal SCK, a latch strobe signal LS, a gate start pulse signal GSP, a gate end pulse signal GEP, and a gate clock signal GCK. Note that in the present embodiment, the gate clock signal GCK is configured by clock signals in eight phases having a duty ratio of 1/2 (that is, 50%).

The source driver 300 receives the digital video signal DV, the source start pulse signal SSP, the source clock signal SCK, and the latch strobe signal LS, which are output from the display controller 200, and applies drive image signals S(1) to S(j) to the source bus lines SL1 to SLj, respectively.

The gate driver 400 repeats application of active scanning signals GOUT (1) to GOUT (i) to the gate bus lines GL1 to GLi, respectively, in a cycle of one vertical scanning period, based on the gate start pulse signal GSP, the gate end pulse signal GEP, and the gate clock signal GCK supplied from the display control circuit 200. The gate driver 400 will be described below in detail.

As described above, the drive video signals S(1) to S(j) are applied to the source bus lines SL1 to SLj respectively, and the scanning signals GOUT(1) to GOUT(i) are applied to the gate bus lines GL1 to GLi respectively, so that an image based on the image signal DAT sent from the outside is displayed on the display portion 600.

1.2 Gate Driver

Hereinafter, the gate driver 400 of the present embodiment will be described in detail.

1.2.1 Configuration and Action of Shift register

Figure 3:
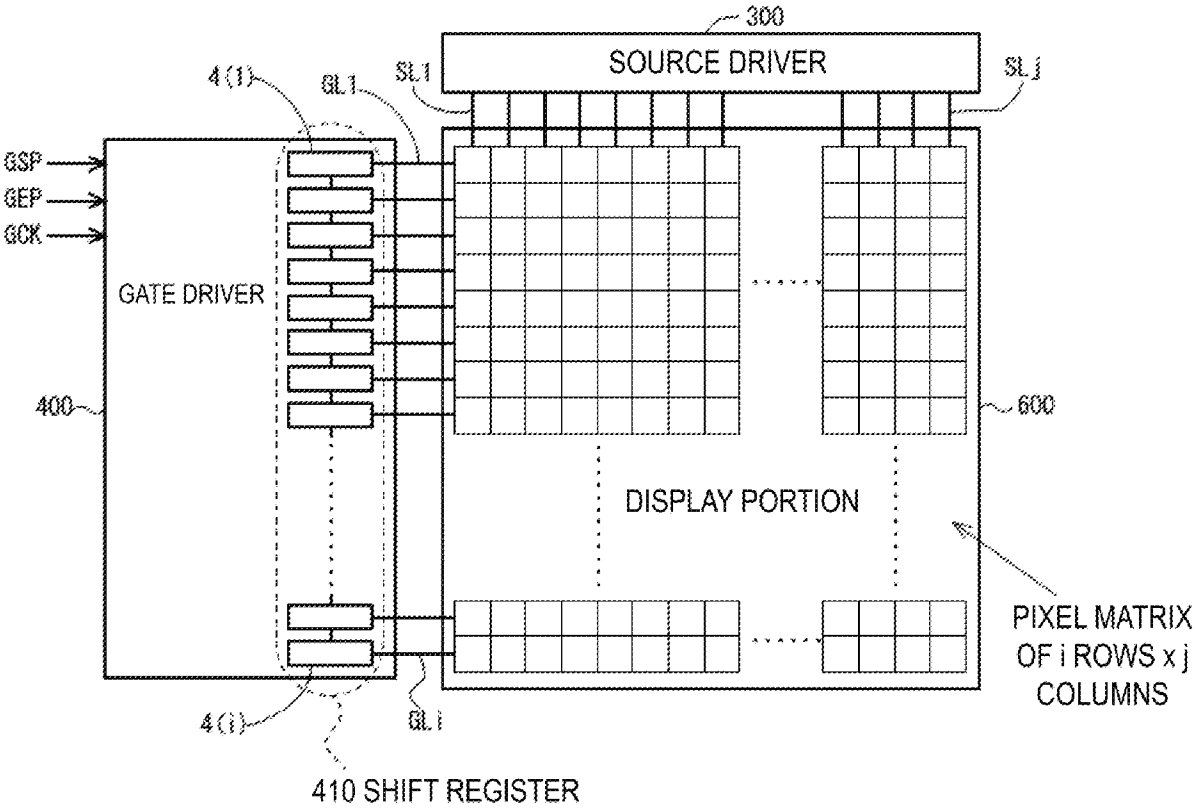
FIG. 3 is a block diagram for describing a configuration of a gate driver in the first embodiment.

FIG. 3 is a block diagram for describing a configuration of the gate driver 400 of the present embodiment. As illustrated in FIG. 3, the gate driver 400 is constituted of the shift register 410 configured of a plurality of stages. In the display portion 600, in a portion where a pixel matrix of i rows by j columns is formed, each stage of the shift register 410 is so provided as to correspond to each row of the pixel matrix on a one-to-one basis. In other words, the shift register 410 includes i unit circuits 4(1) to 4(*i*). There is a case in which a unit circuit as a dummy stage is provided before the first stage or after the i-th stage, but such a case is not directly related to the subject matter of the present disclosure, and therefore description thereof is omitted.

Input/output signals of each unit circuit will be described with reference to FIG. 4 and FIG. 5. Note that in FIG. 5, among the i unit circuits 4(1) to 4(*i*), the unit circuits 4(*n*−4) to 4(*n*+4) of the (n−4)-th stage to the (n+4)-th stage respectively are illustrated. In the following, a reference symbol 4 is assigned to the unit circuits in a case where there is no need to distinguish the i unit circuits 4(1) to 4(*i*) from each other. The gate clock signal GCK is configured of clock signals in eight phases (gate clock signals GCK1 to GCK8). Note that, among the clock signals in eight phases, a clock signal inputted to each unit circuit 4 is denoted by a reference symbol GCKin.

The gate clock signal GCK is supplied to an input terminal of each stage (each unit circuit 4) of the shift register 410 as follows (see FIG. 5). The gate clock signal GCK1 is supplied to the unit circuit 4(*n*−4) of the (n−4)-th stage, the gate clock signal GCK2 is supplied to the unit circuit 4(*n*−3) of the (n−3)-th stage, a gate clock signal GCK3 is supplied to the unit circuit 4(*n*−2) of the (n−2)-th stage, the gate clock signal GCK4 is supplied to the unit circuit 4(*n*−1) of the (n−1)-th stage, the gate clock signal GCK5 is supplied to the unit circuit 4(*n*) of the n-th stage, the gate clock signal GCK6 is supplied to the unit circuit 4(*n*+1) of the (n+1)-th stage, the gate clock signal GCK7 is supplied to the unit circuit 4(*n*+2) of the (n+2)-th stage, and the gate clock signal GCK8 is supplied to the unit circuit 4(*n*+3) of the (n+3)-th stage. Such a configuration is repeated every eight stages through all the stages of the shift register 410. Note that, when the gate clock signal GCK1 is taken as a reference, the phase of the gate clock signal GCKz (z is from 2 to 8) is delayed by (45×(z−1) degrees relative to the phase of the gate clock signal GCK1, as illustrated in FIG. 6.

Figure 4:
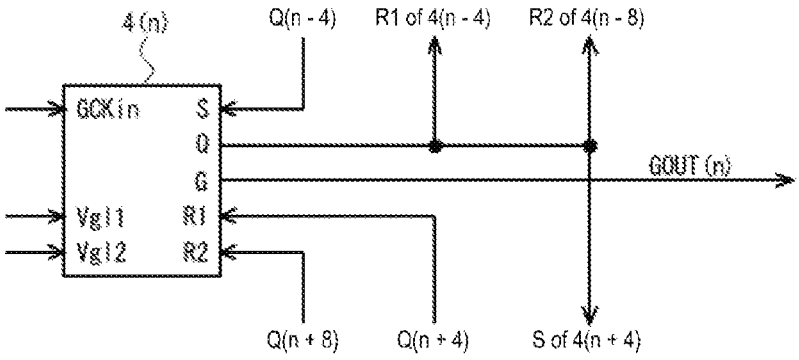
FIG. 4 is a diagram for describing input/output signals of each unit circuit in the first embodiment.
Figure 5:
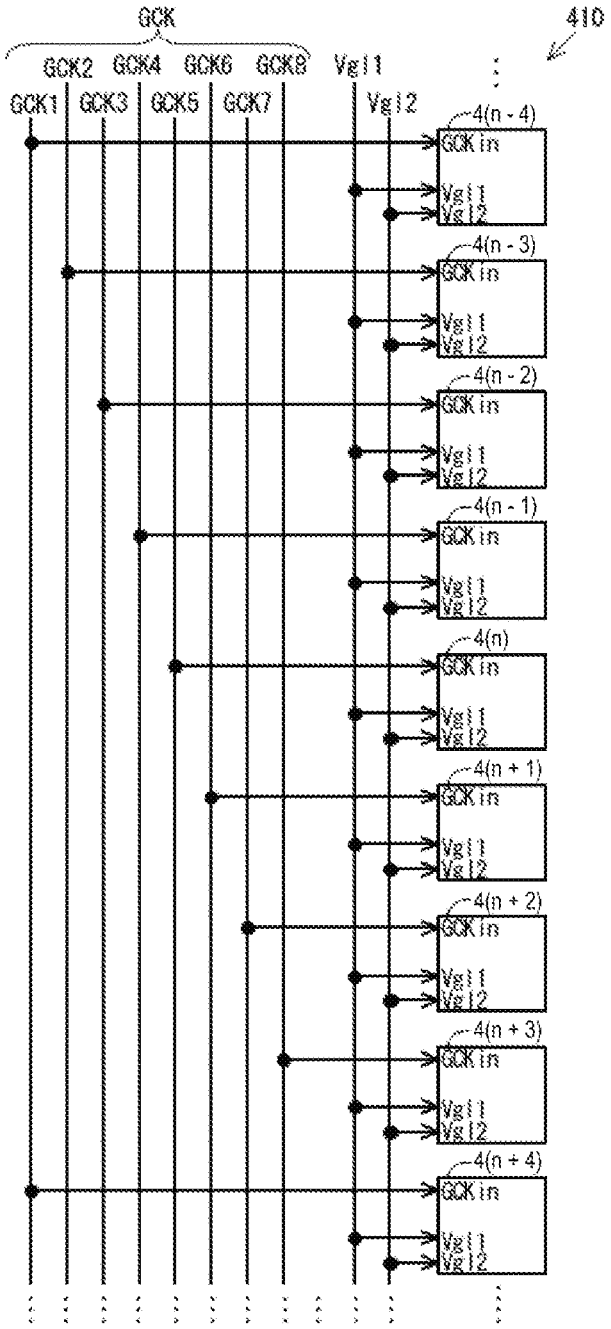
FIG. 5 is a diagram for describing input/output signals of each unit circuit in the first embodiment.
Figure 6:
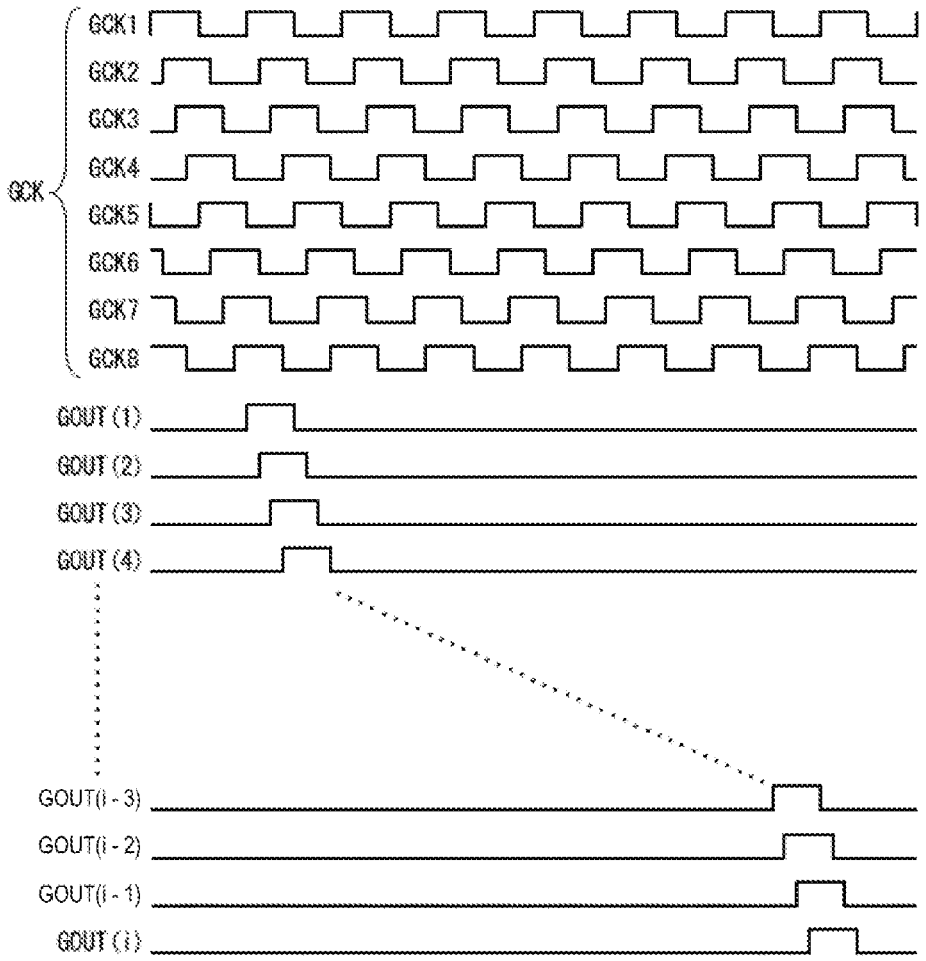
FIG. 6 is a timing chart for describing actions of a gate driver in the first embodiment.

As is understood from FIG. 5, the first gate low voltageVgl1 and the second gate low voltage Vgl2 are commonly supplied to all the unit circuits 4(1) to 4(*i*). Further, for example, focusing on the unit circuit 4(*n*) of the n-th stage, as illustrated in FIG. 4, an output signal Q(n−4) output from the unit circuit 4(*n*−4) positioned forward by four stages is supplied as a set signal S, an output signal Q(n+4) output from the unit circuit 4(*n*+4) positioned backward by four stages is supplied as a first reset signal R1, and an output signal Q(n+8) output from the unit circuit 4(*n*+8) positioned backward by eight stages is supplied as a second reset signal R2. In this example, a unit circuit positioned backward by P stages is implemented by the unit circuit 4(*n*+4) positioned backward by four stages, and a unit circuit positioned backward by Q stages is implemented by the unit circuit 4(*n*+8) positioned backward by eight stages.

As illustrated in FIG. 4, two signals (output signals G and Q) are output from output terminals of each stage (each unit circuit 4) of the shift register 410. The output signal G output from any stage is supplied to the gate bus line GL as a scanning signal GOUT. For example, the output signal Q output from the n-th stage unit circuit 4(*n*) is supplied to the unit circuit 4(*n*−4) positioned forward by four stages as a first reset signal R1, is supplied to the unit circuit 4(*n*−8) positioned forward by eight stages as a second reset signal R2, and is supplied to the unit circuit 4(*n*+4) positioned backward by four stages as a set signal S.

In the above configuration, when a pulse of the gate start pulse signal GSP is supplied as the set signal S to the first stage unit circuit 4(1) or the like of the shift register 410, for example, a shift pulse included in the output signal Q output from each unit circuit 4 is sequentially transferred from the first stage unit circuit 4(1) to the i-th stage unit circuit 4(*i*) based on a clock action of the gate clock signal GCK. Then, in response to the transfer of the shift pulse, the output signal Q and the output signal G (scanning signal GOUT) outputted from each unit circuit 4 are sequentially set to a high level. As a result, as illustrated in FIG. 6, the scanning signals GOUT (1) to GOUT (i), which are sequentially set to the high level (active) for a predetermined period, are supplied to the gate bus lines GL1 to GLi in the display portion 600. In other words, the i gate bus lines GL1 to GLi are sequentially made to be in the select state.

1.2.2 Configuration of Unit Circuit

Figure 7:
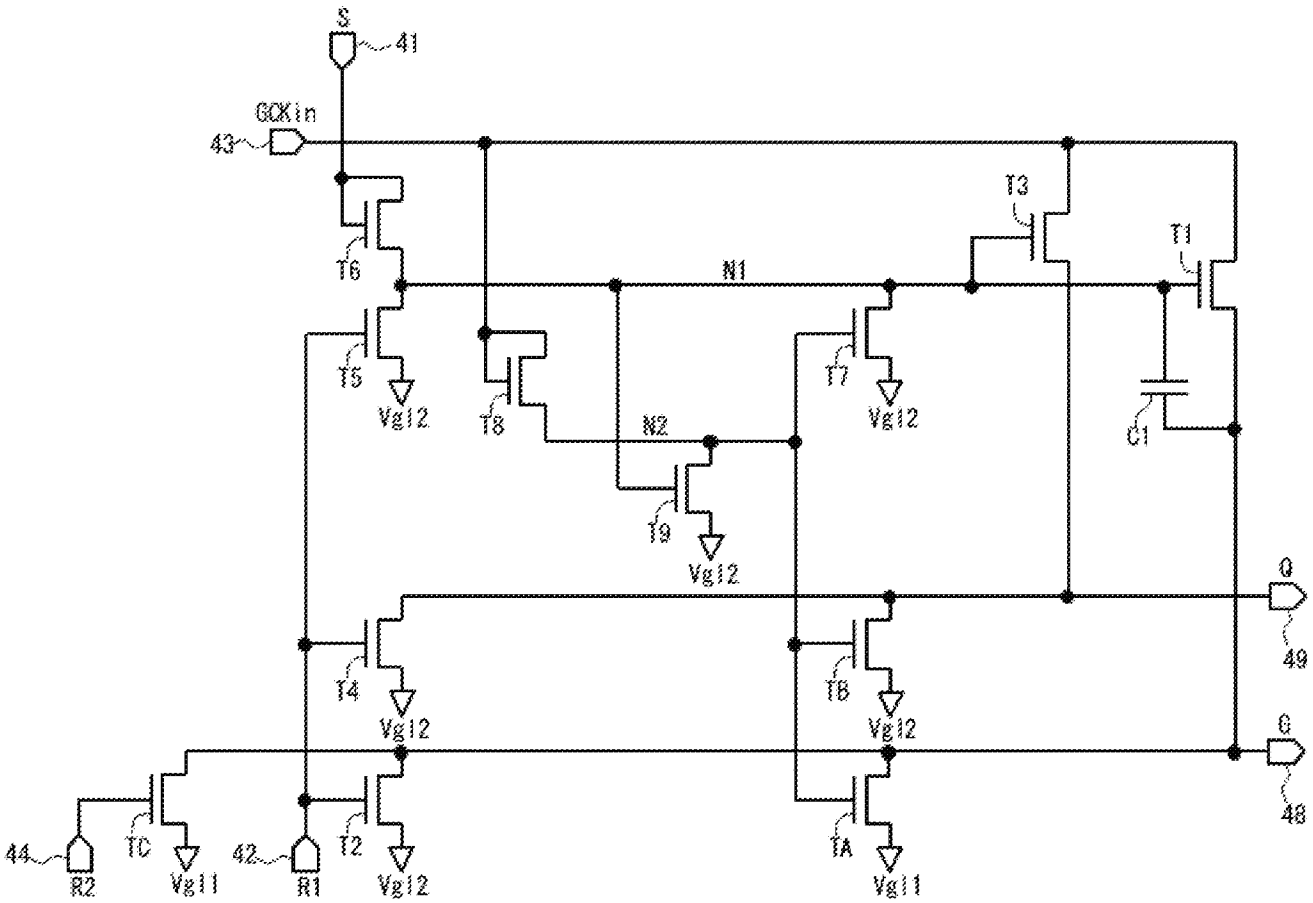
FIG. 7 is a circuit diagram illustrating a configuration of a unit circuit configuration of one stage of a shift register) in the first embodiment.

FIG. 7 is a circuit diagram illustrating a configuration of the unit circuit 4 (configuration of one stage of the shift register 410) in the present embodiment. As illustrated in FIG. 7, the unit circuit 4 includes 12 thin film transistors T1 to T9, TA, TB and TC, and one capacitor (capacitance element) C1 addition to the input terminal for the first gate low voltage Vgl1 and the input terminal for the second gate low voltage Vgl2, the unit circuit 4 includes four input terminals 41 to 44 and two output terminals 48, 49. The input terminal for receiving the set signal S is denoted by a reference symbol 41, the input terminal for receiving the first reset signal R1 is denoted by a reference symbol 42, the input terminal for receiving the gate clock signal GCKin is denoted by a reference symbol 43, and the input terminal for receiving the second reset signal R2 is denoted by a reference symbol 44. The output terminal for outputting the output signal G is denoted by a reference symbol 48, and the output terminal for outputting the output signal Q is denoted by a reference symbol 49. Note that the thin film transistors T1 to T9, TA, TB, and TC in the unit circuit 4 are achieved by the same type of thin film transistor as the thin film transistor 60 (see FIG. 2) in the pixel forming section described above.

Next, a connection relationship between constituent elements in the unit circuit 4 will be described. A gate terminal of the thin film transistor T1, a gate terminal of the thin film transistor T3, a drain terminal of the thin film transistor T5, a source terminal of the thin film transistor T6, a drain terminal of the thin film transistor T7, a gate terminal of the thin film transistor T9, and one terminal of the capacitor C1 are connected to one another, Note that a region (wiring line) where these terminals are connected to one another will be referred to as a "first node" for the sake of convenience. The first node is denoted by a reference symbol N1. A gate terminal of the thin film transistor T7, a source terminal of the thin film transistor T8, a drain terminal of the thin film transistor T9, a gate terminal of the thin film transistor TA, and a gate terminal of the thin film transistor TB are connected to one another. Note that a region (wiring line) where these terminals are connected to one another will be referred to as a "second node" for the sake of convenience. The second node is denoted by a reference symbol N2.

Regarding the thin film transistor T1, the gate terminal is connected to the first node N1, a drain terminal is connected to the input terminal 43, and a source terminal is connected to the output terminal 48. Regarding the thin film transistor T2, a gate terminal is connected to the input terminal 42, a drain terminal is connected to the output terminal 48, and a source terminal is connected to the input terminal for the second gate low voltage Vgl2. Regarding the thin film transistor T3, the gate terminal is connected to the first node N1, a drain terminal is connected to the input terminal 43, and a source terminal is connected to the output terminal 49, Regarding the thin film transistor T4, a gate terminal is connected to the input terminal 42, a drain terminal is connected to the output terminal 49, and a source terminal is connected to the input terminal for the second gate low voltage Vgl2. Regarding the thin film transistor T5, a gate terminal is connected to the input terminal 42, the drain terminal is connected to the first node N1, and a source terminal is connected to the input terminal for the second gate low voltage Vgl2. Regarding the thin film transistor T6, both a gate terminal and a drain terminal are connected to the input terminal 41 (in other words, diode-connected), and the source terminal is connected to the first node N1.

Regarding the thin film transistor T7, the gate terminal is connected to the second node N2, the drain terminal is connected to the first node N1, and a source terminal is connected to the input terminal for the second gate low voltage Vgl2. Regarding the thin film transistor T8, both a gate terminal and a drain terminal are connected to the input terminal 43 (in other words, diode-connected), and the source terminal is connected to the second node N2. Regarding the thin film transistor T9, the gate terminal is connected to the first node N1, the drain terminal is connected to the second node N2, and a source terminal is connected to the input terminal for the second gate low voltage Vgl2. Regarding the thin film transistor TA, the gate terminal is connected to the second node N2, a drain terminal is connected to the output terminal 48, and a source terminal is connected to the input terminal for the first gate low voltage Vgl1. Regarding the thin film transistor TB, the gate terminal is connected to the second node N2, a drain terminal is connected to the output terminal 49, and a source terminal is connected to the input terminal for the second gate low voltage Vgl2. Regarding the thin film transistor TC, a gate terminal is connected to the input terminal 44, a drain terminal is connected to the output terminal 48, and a source terminal is connected to the input terminal for the first gate low voltage Vgl1. As for the capacitor C1, one end is connected to the first node N1, and the other end is connected to the output terminal 48.

Note that the thin film transistor T2 corresponds to the gate output lowering transistor T01 in FIG. 1, the thin film transistor TA corresponds to the gate output stabilizing transistor T02 in FIG. 1, and the thin film transistor TC corresponds to the gate output reset transistor T03 in FIG. 1.

Next, functions of the constituent elements in the unit circuit 4 will be described. The thin film transistor T1 supplies the voltage of the gate clock signal GCKin to the output terminal 48 when the potential of the first node N1 is at the high level. The thin film transistor T2 changes the output signal G toward the second low level when the first reset signal R1 is at the high level. The thin film transistor T3 supplies the voltage of the gate clock signal GCKin to the output terminal 49 when the potential of the first node N1 is at the high level. The thin film transistor T4 changes the output signal Q toward the second low level when the first reset signal R1 is at the high level. The thin film transistor T5 changes the potential of the first node N1 toward the second low level when the first reset signal R1 is at the high level.

The thin film transistor T6 changes the potential of the first node N1 toward the high level when the set signal S is at the high level. The thin film transistor T7 changes the potential of the first node N1 toward the second low level when the potential of the second node N2 is at the high level. The thin film transistor T8 changes the potential of the second node N2 toward the high level when the gate clock signal GCKin is at the high level. The thin film transistor T9 changes the potential of the second node N2 toward the second low level when the potential of the first node N1 is at the high level. The thin film transistor TA changes the output signal G toward the first low level when the potential of the second node N2 is at the high level. The thin film transistor TB changes the output signal Q toward the second low level when the potential of the second node N2 is at the high level. The thin film transistor TC changes the output signal G toward the first low level when the second reset signal R2 is at the high level. The capacitor C1 functions as a boost capacity for raising the potential of the first node N1.

In the present embodiment, thin film transistors T8 and T9 in the configuration illustrated in FIG. 7 control the potential of the second node N2, but the embodiment is not limited to such a configuration. As long as the potential of the second node N2 is set to the low level during a period in which the potential of the first node N1 has to be maintained at the high level, and the potential of the second node N2 is set to the high level during a period in which the gate clock signal GCKin is at the high level within a period in which the potential of the first node N1 has to be maintained at the low level, the potential of the second node N2 may be controlled by a configuration other than the configuration illustrated in FIG. 7.

In the present embodiment, a select control transistor is achieved by the thin film transistor T1, a non-select control transistor is achieved by the thin film transistor T2, an output control transistor is achieved by the thin film transistor T3, a non-output control transistor is achieved by the thin film transistor T4, a first node turn-off transistor is achieved by the thin film transistor T5, a first node turn-on transistor is achieved by the thin film transistor T6, a first node stabilizing transistor is achieved by the thin film transistor T7, a second node turn-on transistor is achieved by the thin film transistor T8, a second node turn-off transistor is achieved by the thin film transistor T9, a first output node stabilizing transistor is achieved by the thin film transistor TA, a second output node stabilizing transistor is achieved by the thin film transistor TB, and a first output node reset transistor is achieved by the thin film transistor TC. Further, a first output node is achieved by the output terminal 48, and a second output node is achieved by the output terminal 49.

1.2.3 Actions of Unit Circuit

Figure 8:
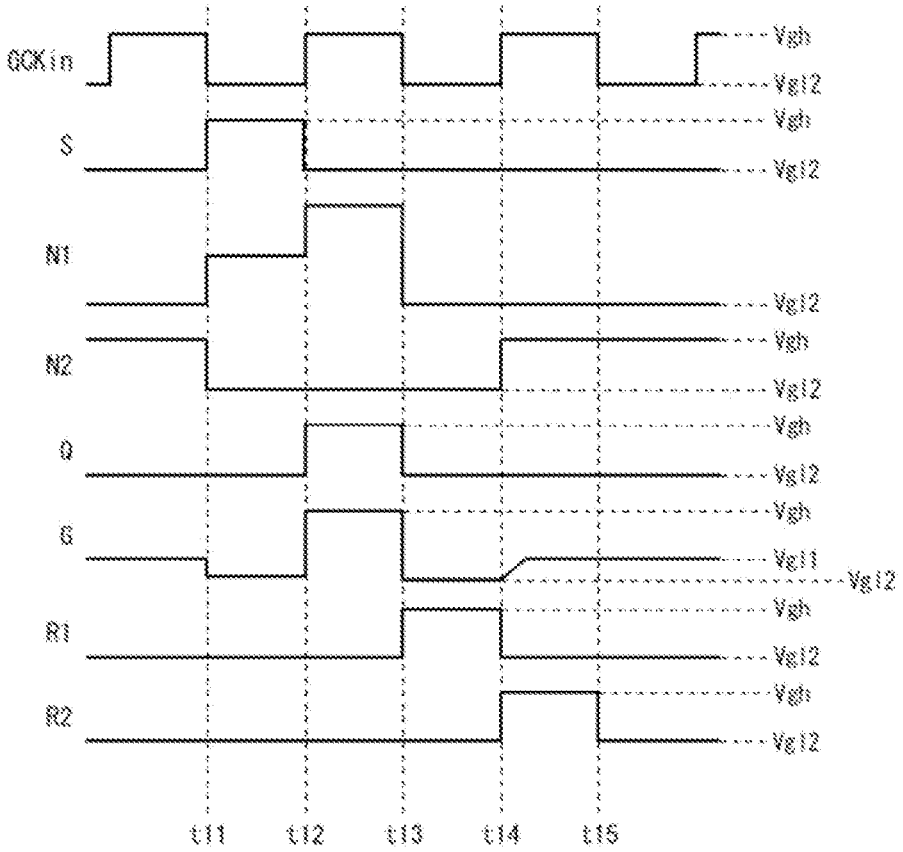
FIG. 8 is a timing chart for describing actions of a unit circuit in the first embodiment.

Next, actions of the unit circuit 4 according to the present embodiment will be described while referring to FIG. 8. Each of a period from a time point t11 to a time point t12, a period from the time point t12 to a time point t13, a period from the time point t13 to a time point t14, and a period from the time point t14 to a time point t15 is one horizontal scan period. Here, a delay of the waveform of each signal, except for the waveform of the output signal G immediately after the time point t14, is ignored.

Through e action period of the liquid crystal display device, the gate clock signal GCKin alternates between the high level and the low level. The high level voltage of the gate clock signal GCKin is a voltage (hereinafter referred to as a "gate high voltage") Vgh having a voltage level for bringing the gate bus line GL to the select state. The low level voltage of the gate clock signal GCKin is the second gate low voltage Vgl2 in the present embodiment. However, the low level voltage of the gate clock signal GCKin is not limited to the second gate low voltage Vgl2 as long as the voltage has a voltage level that brings the gate bus line GL to the non-select state.

In a period before the time point t11, the set signal S is set to the second low level, the potential of the first node N1 is set to the second low level, the potential of the second node N2 is set to the high level, the output signal Q is set to the second low level, the output signal G is set to the first low level, the first reset signal R1 is set to the second low level, and the second reset signal R2 is set to the second low level. Incidentally, parasitic capacitance exists in the thin film transistors in the unit circuit 4. Because of this, in the period before the time point t11, the potential of the first node N1 may fluctuate due to a clock action of the gate clock signal GCKin and the presence of parasitic capacitance of the thin film transistors T1 and T3 (see FIG. 7), As a result, the voltage of the output voltage G, that is, the voltage of the scanning signal output GOUT supplied to the gate bus line GL may be increased. However, the thin film transistor T7 is maintained in the on state during a period in which the potential of the second node N2 is maintained at the high level. Thus, in the period before the time point t11, the thin film transistor T7 is maintained in the on state, and the potential of the first node N1 is reliably maintained at the second low level. As described above, even when noise due to the clock action of the gate clock signal GCKin enters into the first node N1, the voltage of the corresponding scanning signal GOUT does not rise. As a result, failures such as a display failure and the like due to the clock action of the gate clock signal GCKin are prevented.

At the time point t11, the set signal S changes from the second low level to the high level. Since the thin film transistor T6 is diode-connected as illustrated in FIG. 7, the pulse of the set signal S brings the thin film transistor T6 to the on state, so that the potential of the first node N1 rises. Consequently, the thin film transistors T1, T3, and T9 are each set to be in the on state. By setting the thin film transistor T9 to be in the on state, the potential of the second node N2 is set to the second low level. Note that, in the period from the time point t11 to the time point t12, since the gate clock signal GCKin is at the low level, the output signal G is lowered to the second low level by setting the thin film transistor T1 to be in the on state, and the output signal Q is maintained at the second low level even when the thin film transistor T3 is in the on state. Further, in the period from the time point t11 to the time point t12, the first reset signal R1 is maintained at the second low level, and the potential of the second node N2 is also maintained at the second low level. Therefore, during this period, the potential of the first node N1 is not lowered due to the thin film transistors T5 and T7 being provided.

At the time t12, the gate clock signal GCKin changes from the low level to the high level. At this time, since the thin film transistor T1 is in the on state, the potential of the output terminal 48 rises along with the rise of the potential of the input terminal 43. Here, since the capacitor C1 is provided between the first node N1 and the output terminal 48 as illustrated in FIG. 7, the potential of the first node N1 rises along with the rise of the potential of the output terminal 48 (the first node N1 is brought to a boost state). As a result, a high voltage is applied to the gate terminals of the thin film transistors T1 and T3, and the voltage of the output signal G and the voltage of the output signal Q rise up to the voltage level of the high level voltage of the gate clock signal GCKin (that is, the voltage level of the gate high voltage Vgh). Further, in the period from the time point t12 to the time point t13, the first reset signal R1 and the second reset signal R2 are maintained at the second low level, and the potential of the second node N2 is also maintained at the second low level. Accordingly, during this period, the potential of the first node N1 is not lowered due to the thin film transistors T5 and T7 being provided, the voltage of the output signal G is not lowered due to the thin film transistors T2, TC and TA being provided, and the voltage of the output signal Q is not lowered due to the thin film transistors T4 and TB being provided.

At the time point t13, the first reset signal R1 changes from the second low level to the high level. Consequently, the thin film transistors T2, T4, and T5 are each set to be in the on state. The output signal G (that is, the scanning signal GOUT) is set to the second low level by the thin film transistor T2 being brought to the on state, the output signal Q is set to the second low level by the thin film transistor T4 being brought to the on state, and the potential of the first node N1 is set to the second low level by the thin film transistor T5 being brought to the on state.

At the time point t14, the second reset signal R2 changes from the second low level to the high level. With this, the thin film transistor TC is brought to the on state, and the output signal G rises from the second low level to the first low level. Further, at the time point t14, the gate clock signal GCKin changes from the low level to the high level. Since the thin film transistor T8 is diode-connected as illustrated in FIG. 7, the potential of the second node N2 is set to the high level when the gate clock signal GCKin changes from the v level to the high level. Consequently, the thin film transistors T7, TA, and TB are each set to be in the on state. By the thin film transistor T7 being brought to the on state, even in a case where noise due to the clock action of the gate clock signal GCKin enters into the first node N1 in the period from the time point t14 onward, the potential of the first node N1 is brought into the second low level. Further, by the thin film transistor TB being brought to the on state, even in a case where noise due to the clock action of the gate clock signal GCKin enters into the output terminal 49 in the period from the time point t14 onward, the output signal Q is brought into the second low level. Likewise, by the thin film transistor TA being brought to the on state, even in a case where noise due to the clock action of the gate clock signal GCKin enters into the output terminal 48, the output signal G is brought into the first low level. Then, in the period from the time point t15 onward, the same actions as those carried out in the period before the time point t11 are carried out.

By such actions being carried out in each unit circuit 4, the plurality of gate bus lines GL(1) to GL(i) provided in the liquid crystal display device are sequentially made to be in the select state, and the writing into the pixel capacitance is sequentially performed. As a result, an image based on the image signal DAT sent from the outside is displayed on the display portion 600 (see FIG. 2).

1.3 Effects

According to the present embodiment, as low level DC power supply voltages for controlling actions of the gate driver 400, there are prepared the first gate low voltage Vgl1 with a voltage level having been used for bringing a pixel TFT (the thin film transistor 60 in FIG. 2) to an off state (bringing the gate bus line GL to a non-select state) and the second gate low voltage Vgl2 with a voltage level lower than the first gate low voltage Vgl1. Then, a technique is employed in which, at the time of lowering the gate output, the voltage of the scanning signal is made to once drop to the voltage level of the second gate low voltage Vgl2 and thereafter is made to change to the voltage level of the first gate low voltage Vgl1. In the present embodiment, in order to implement this technique, each unit circuit 4 constituting the shift register 410 in the gate driver 400 is provided with the thin film transistor TC including the gate terminal connected to the input terminal 44 for receiving the second reset signal R2, the drain terminal connected to the output terminal 48, and the source terminal connected to the input terminal for the first gate low voltage Vgl1 (see FIG. 7). Then, at the end of each horizontal scan period, in a row corresponding to the gate bus line GL having been in the select state, the voltage of the scanning signal once drops to the voltage level of the second gate low voltage Vgl2, and thereafter changes to the voltage level of the first gate low voltage Vgl1 by the thin film transistor TC being brought to the on state based on the second reset signal R2. In contrast, in the configuration disclosed in WO 2018/193912 pamphlet, the voltage of the scanning signal changes from the voltage level of the second gate low voltage Vgl2 to the voltage level of the first gate low voltage Vgl1 by the gate output stabilizing transistor (the transistor denoted by the reference symbol T02 in FIG. 1, the thin film transistor TA in FIG. 7) being brought to the on state.

Figure 9:
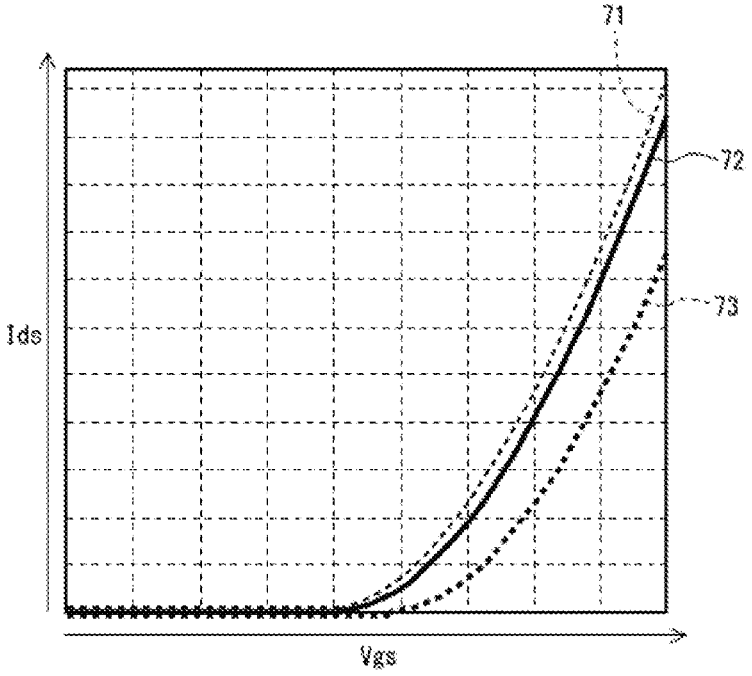
FIG. 9 is a diagram for describing an effect of the first embodiment.
Figure 10:
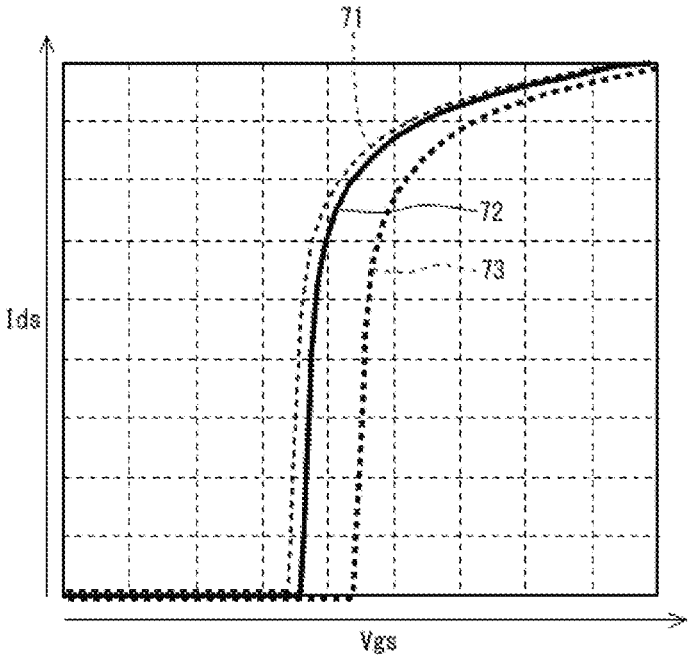
FIG. 10 is a diagram for describing an effect of the first embodiment.

Here, with reference to FIG. 9 and FIG. 10, a difference in magnitude of the threshold shifts of a thin film transistor due to a difference in duty ratio of the bias voltages (bias voltages applied to the gate terminal of the thin film transistor) will be described. In FIG. 9 and FIG. 10, the horizontal axis represents a gate-source voltage Vgs, and the vertical axis represents a drain-source current Ids. A dotted line indicated by a reference symbol 71 represents characteristics of the thin film transistor at the initial time point, a thick line indicated by a reference symbol 72 represents the characteristics of the thin film transistor after a predetermined period of time has passed since the initial time point in the case where the bias voltage duty ratio is 1%, and a thick dotted line indicated by a reference symbol 73 represents the characteristics of the thin film transistor after the predetermined period of time has passed since the initial time point in the case where the bias voltage duty ratio is 100%. Note that FIG. 9 is a linear graph, and FIG. 10 is a semi-logarithmic graph taking the vertical axis as a logarithm. From FIG. 9 and FIG. 10, it is understood that the change in the characteristics due to the passage of time is large when the bias voltage duty ratio is 100%, while the change in the characteristics due to the passage of time is small when the bias voltage duty ratio is 1%. In other words, the larger the bias voltage duty ratio is, the larger the threshold shift is. Therefore, when the bias voltage duty ratio is 1%, the threshold shift is significantly small in comparison with the case where the bias voltage duty ratio is 100%.

As described above, the gate output stabilizing transistor is maintained in the on state for most of the period in which actions of the device are carried out. That is, the bias voltage duty ratio of the gate output stabilizing transistor is significantly large. In contrast, the thin film transistor TC in FIG. 7 is set to the on state for only one horizontal scan period in each vertical scanning period. In other words, as for the thin film transistor TC, the bias voltage duty ratio is significantly small.

As described above, the threshold shift of the thin film transistor TC is significantly smaller than the threshold shift of the gate output stabilizing transistor. Since the threshold shift of the thin film transistor TC is small in this manner, in the present embodiment, even after the long-time use of the device, the voltage of the scanning signal changes from the voltage level of the second gate low voltage Vgl2 to the voltage level of the first gate low voltage Vgl1 in a relatively short time at the time of lowering the gate output.

Figure 11:
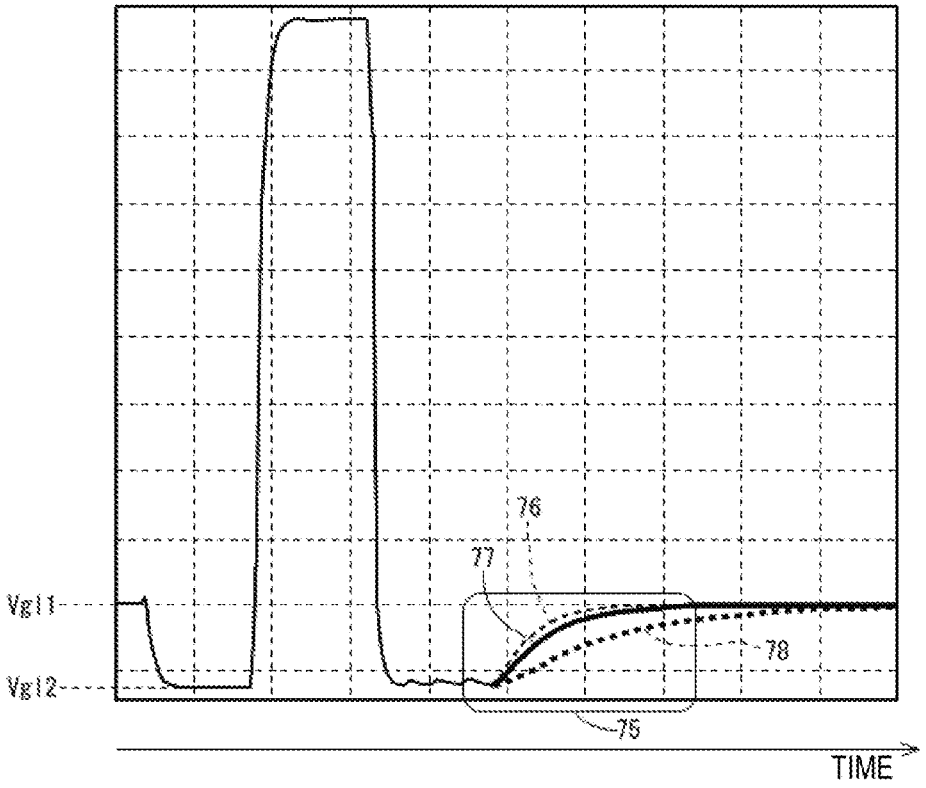
FIG. 11 is a diagram for describing an effect of the first embodiment.
Figure 12:
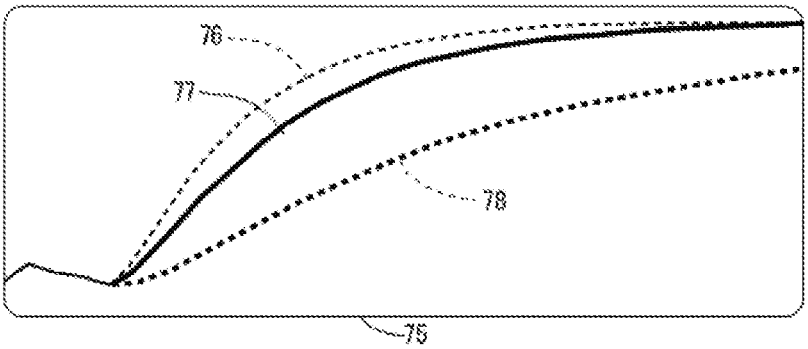
FIG. 12 is a diagram for describing an effect of the first embodiment.

FIG. 11 and FIG. 12 are waveform diagrams illustrating a simulation result relating to the lowering of the gate output. Note that FIG. 12 is an enlarged view of a portion indicated by a reference symbol 75 in FIG. 11. In each of FIG. 11 and FIG. 12, a dotted line indicated by a reference symbol 76 represents a waveform in a configuration using a thin film transistor having initial characteristics, a thick solid line indicated by a reference symbol 77 represents a waveform in the configuration according to the present embodiment, and a thick dotted line indicated by a reference symbol 78 represents a waveform in the configuration disclosed in WO 2018/193912 pamphlet (the configuration not including the thin film transistor TC in FIG. 7). As is understood from FIG. 11 and FIG. 12, by providing the thin film transistor TC in the unit circuit 4, the time required for the voltage of the scan signal to change from the voltage level of the second gate low voltage Vgl2 to the voltage level of the first gate low voltage Vgl1 becomes significantly short in comparison with the configuration disclosed in WO 2018/193912 pamphlet.

As described above, according to the present embodiment, achieved is the gate driver 400 able to quickly change the voltage of the scanning signal to the desired level at the end of each horizontal scan period, regardless of the length of the term of use of the device.

1.4 Modification Example

In the first embodiment described above, clock signals in eight phases having a duty ratio of 1/2 (that is, 50%) are used as the gate clock signal GCK. However, the duty ratio and the number of phases of the gate clock signal GCK are not particularly limited. In a case where Za and Zb are taken as integers, and clock signals in Za phases having a duty ratio of Zb/Za are used, it is sufficient to configure the shift register 410 in the gate driver 400 so that each signal is supplied to each unit circuit 4 as follows. An output signal Q output from a unit circuit positioned forward by Zb stages is supplied as a set signal S, an output signal Q output from a unit circuit positioned backward by Zb stages is supplied as a first reset signal R1, and an output signal Q output from a unit circuit positioned backward by (Zb×2) stages is supplied as a second reset signal R2.

Figure 13:
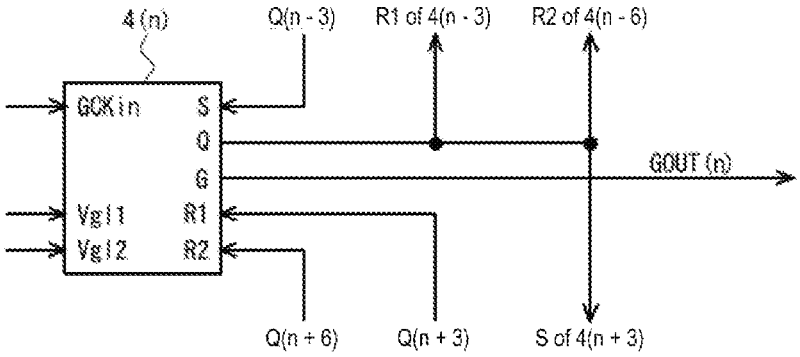
FIG. 13 is a diagram for describing input/output signals of each unit circuit in a modification example of the first embodiment.

For example, in a case where clock signals in eight phases having a duty ratio of 3/8 are used as a gate clock signal GCK, it is sufficient to configure the shift register 410 in the gate driver 400 in such a manner that input/output signals of each unit circuit 4 serve as follows. Focusing on a unit circuit 4(*n*) of the n-th stage, as illustrated in FIG. 13, an output signal Q(n−3) output from a unit circuit 4(*n*−3) positioned forward by three stages is supplied as a set signal S, an output signal Q(n+3) output from a unit circuit 4(*n*+3) positioned backward by three stages is supplied as a first reset signal R1, and an output signal Q(n+6) output from a unit circuit 4(*n*+6) positioned backward by six stages is supplied as a second reset signal R2. Further, an output signal Q output from the n-th stage unit circuit 4(*n*) is supplied to the unit circuit 4(*n*−3) positioned forward by three stages as a first reset signal R1, is supplied to a unit circuit 4(*n*−6) positioned forward by six stages as a second reset signal R2, and is supplied to the unit circuit 4(*n*+3) positioned backward by three stages as a set signal S.

Furthermore, for example, in a case where clock signals in six phases having a duty ratio of 3/6 are used as the gate clock signal GCK, it is sufficient to configure the shift register 410 in the gate driver 400 in such a manner that input/output signals of each unit circuit 4 serve as follows. Focusing on the unit circuit 4(*n*) of the n-th stage, the output signal Q(n−3) output from the unit circuit 4(*n*−3) positioned forward by three stages is supplied as a set signal 5, the output signal Q(n+3) output from the unit circuit 4(*n*+3) positioned backward by three stages is supplied as a first reset signal R1, and the output signal Q(n+6) output from the unit circuit 4(*n*+6) positioned backward by six stages is supplied as a second reset signal R2. Further, the output signal Q output from the n-th stage unit circuit 4(*n*) is supplied to the unit circuit 4(*n*−3) positioned forward by three stages as a first reset signal is supplied to the unit circuit 4(*n*−6) positioned forward by six stages as a second reset signal R2, and is supplied to the unit circuit 4(*n*+3) positioned backward by three stages as a set signal S.

2. Second Embodiment 2.1 Overview

Figure 14:
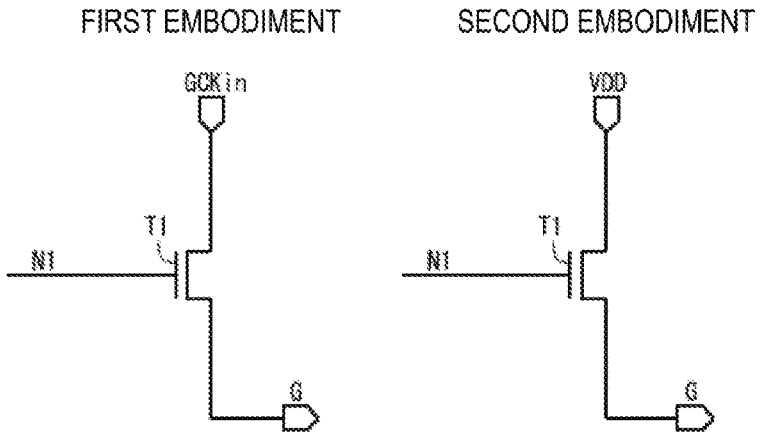
FIG. 14 is a diagram for describing a difference between a second embodiment and the first embodiment.

In the above-described first embodiment, the gate clock signal GCKin is supplied to the drain terminal of the thin film transistor T1 in the unit circuit 4 (see FIG. 7). Because such a configuration is employed, a relatively large capacity needs to be driven by the gate clock signal GCKin, which is an alternating current signal. As a result, the amount of power consumption is relatively large. Therefore, a liquid crystal display device according to the present embodiment employs a configuration in which a high level DC power supply voltage VDD is supplied to the drain terminal of a thin film transistor T1 (see FIG. 14). The general configuration is similar to that of the first embodiment, so that the description thereof is omitted (see FIG. 2).

2.2 Gate Driver

Hereinafter, a gate driver 400 of the present embodiment will be described in detail. The following mainly describes differences from the first embodiment.

2.2.1 Configuration and Actions of Shift Register

Figure 15:
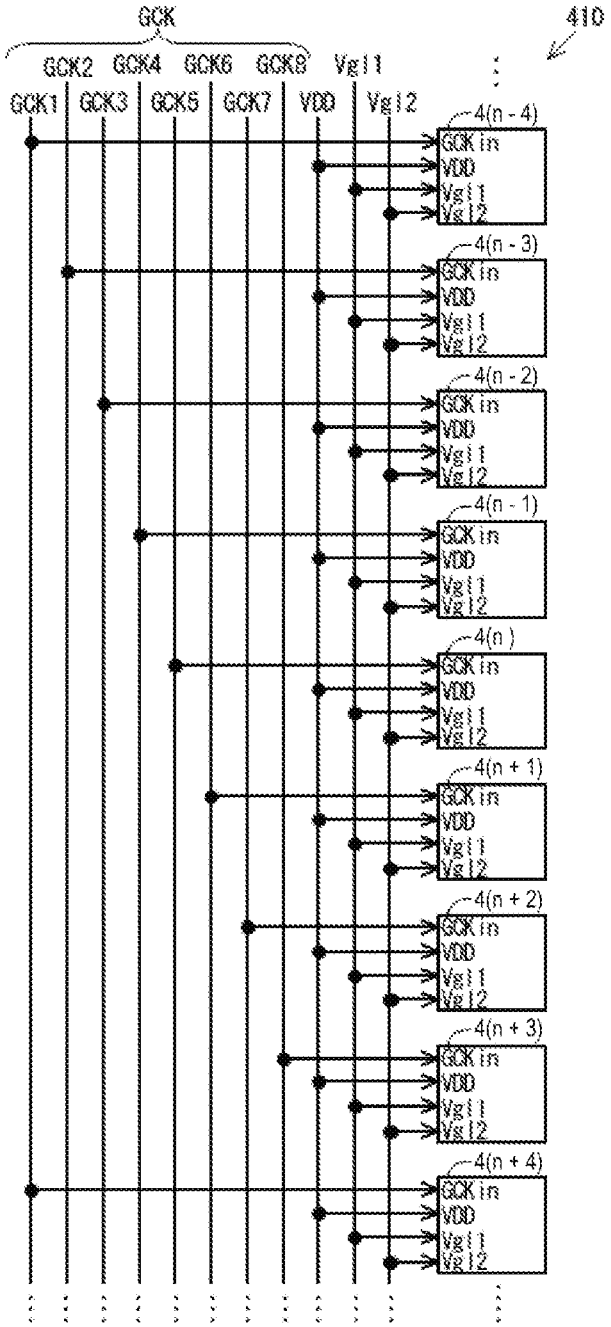
FIG. 15 is a diagram for describing input/output signals of each unit circuit in the second embodiment.

As illustrated in FIG. 3, the gate driver 400 according to the present embodiment is constituted of a shift register 410 including i unit circuits 4(1) to 4(*i*). Input/output signals of each unit circuit will be described with reference to FIG. 4 and FIG. 15. A gate clock signal GCKin, a first gate low voltage Vgl1, a second gate low voltage Vgl2, a set signal S, a first reset signal R1, a second reset signal R2, an output signal Q, and an output signal G are the same as those in the first embodiment. In the present embodiment, a high level DC power supply voltage VDD is further supplied to each unit circuit 4. Note that the voltage level of the DC power supply voltage VDD is the voltage level of the gate high voltage Vgh described above.

Note that, herein, description is given assuming that clock signals in eight phases having a duty ratio of 1/2 (that is, 50%) are used as the gate clock signal GCK. However, the duty ratio and the number of phases of the gate clock signal GCK are not particularly limited.

2.2.2 Configuration of Unit Circuit

Figure 16:
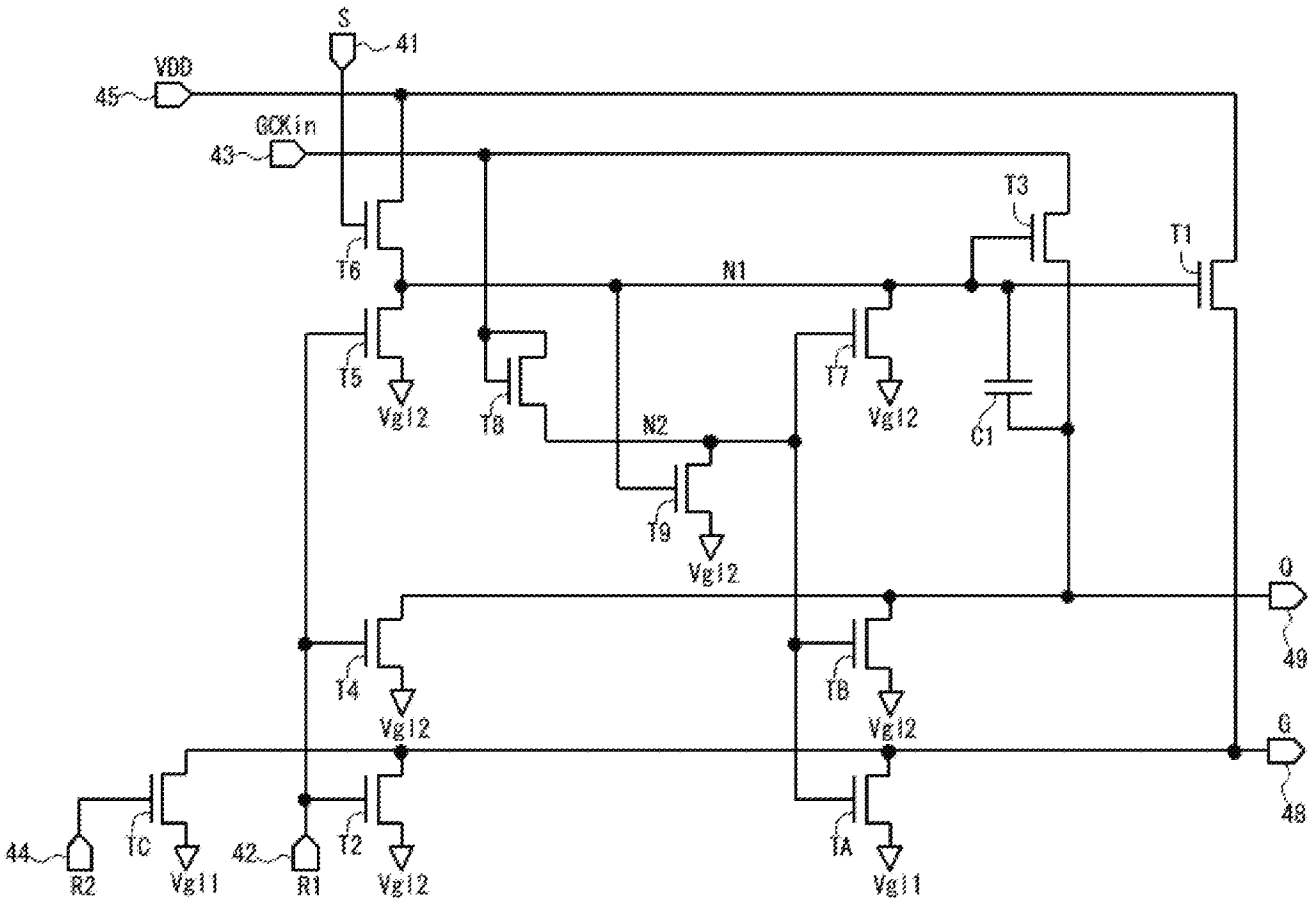
FIG. 16 is a circuit diagram illustrating a configuration of a unit circuit (configuration of one stage of a shift register) in the second embodiment.

FIG. 16 is a circuit diagram illustrating a configuration of the unit circuit 4 (configuration of one stage of the shift register 410) in the present embodiment. In addition to the constituent elements of the first embodiment (see FIG. 7), provided is an input terminal 45 for receiving the high level DC power supply voltage VDD. In the present embodiment, the drain terminal of the thin film transistor T1 is connected to the input terminal 45. The high level DC power supply voltage VDD is supplied to the drain terminal of the thin film transistor T1. The other end of the capacitor C1 is connected to the output terminal 48 in the first embodiment, but is connected to an output terminal 49 in the present embodiment. In other words, the capacitor C1 is provided between the gate and source of a thin film transistor T3.

2.2.3 Actions of Unit Circuit

Figure 17:
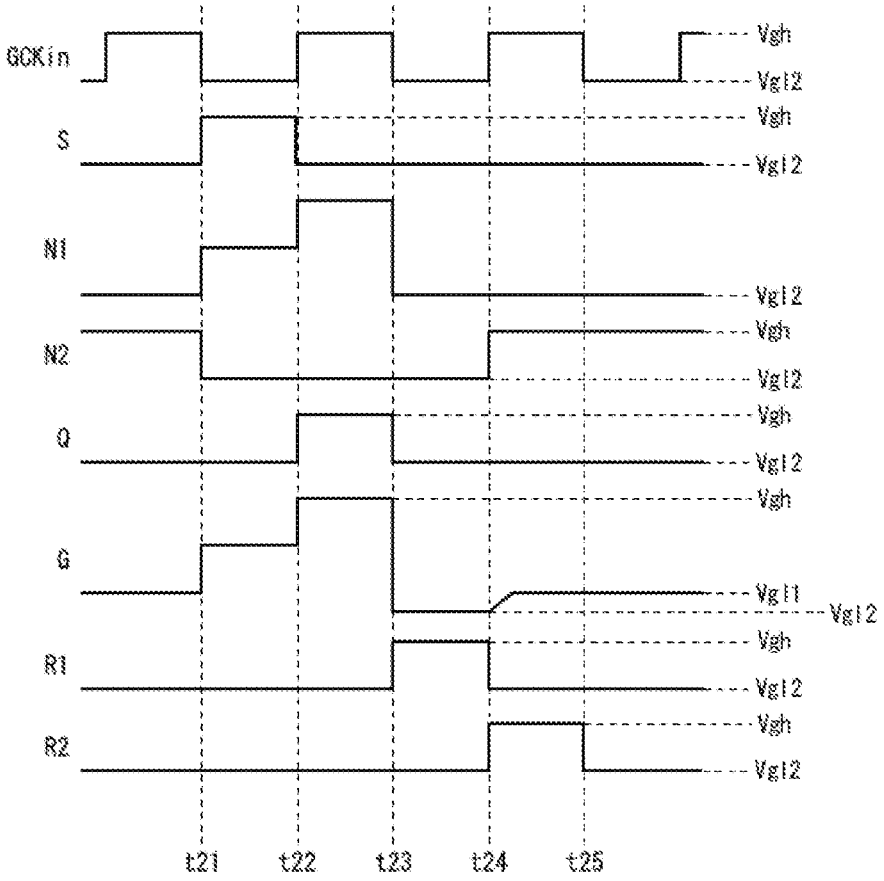
FIG. 17 is a timing chart for describing actions of a unit circuit in the second embodiment.

Next, actions of the unit circuit 4 according to the present embodiment will be described while referring to FIG. 17. Each of a period from a time point t21 to a time point t22, a period from the time point t22 to a time point t23, a period from the time point t23 to a time point t24, and a period from the time point t24 to a time point t25 is one horizontal scan period. Here, a delay of the waveform of each signal, except for the waveform of an output signal G immediately after the time point t24, is ignored.

In a period before the time point t21, the same actions as those carried out in the period before the time point t11 in the first embodiment (see FIG. 8) are carried out. At the time point t21, the set signal S changes from the second low level to the high level. A pulse of the set signal S brings a thin film transistor T6 to an on state, so that the potential of a first node N1 rises. Consequently, the thin film transistors T1 and T3, and a thin film transistor T9 are each set to be the on state. When the thin film transistor T1 is brought to the on state, the voltage of the output signal G rises. However, the voltage rises up to a voltage level lower than the voltage level of the DC power supply voltage VDD (that is, the voltage level of the gate high voltage Vgh) by a voltage of the threshold value of the thin film transistor T1. Further, by the thin film transistor T9 being brought to the on state, the potential of a second node N2 is set to the second low level. Note that, in the period from the time point t21 to the time point t22, since the gate clock signal GCKin is at the low level, the output signal Q is maintained at the second low level even when the thin film transistor T3 is in the on state. Furthermore, in the time period from the time point t21 to the time point t22, the first reset signal R1 is maintained at the second low level, and the potential of the second node N2 is also maintained at the second low level. Therefore, during this period, the potential of the first node N1 is not lowered due to thin film transistors T5 and T7 being provided.

At the time point t22, the gate clock signal GCKin changes from the low level to the high level. At this time, since the thin film transistor T3 is in the on state, the potential of the output terminal 49 rises along with the rise of the potential of an input terminal 43. Here, since the capacitor C1 is provided between the first node N1 and the output terminal 49 as illustrated in FIG. 16, the potential of the first node N1 rises along with the rise of the potential of the output terminal 49 (the first node N1 is brought to a boost state). As a result, a high voltage is applied to the gate terminals of the thin film transistors T1 and T3, the voltage of the output signal G rises up to the voltage level of the DC power supply voltage VDD (that is, the voltage level of the gate high voltage Vgh), and the voltage of the output signal Q rises up to the voltage level of the high level voltage of the gate clock signal GCKin (that is, the voltage level of the gate high voltage Vgh). Further, in the period from the time point t22 to the time point t23, the first reset signal R1 and the second reset signal R2 are maintained at the second low level, and the potential of the second node N2 is also maintained at the second low level. Accordingly, during this period, the potential of the first node N1 is not lowered due to the thin film transistors T5 and T7 being provided, the voltage of the output signal G is not lowered due to thin film transistors T2, TC and TA being provided, and the voltage of the output signal Q is not lowered due to thin film transistors T4 and TB being provided. In the period from the time point t23 onward, the same actions as those carried out in the period from the time point t13 onward in the first embodiment (see FIG. 8) are carried out.

By such actions being carried out in each unit circuit 4, similarly to the first embodiment, the plurality of gate bus lines GL(I) to GL(i) provided in the liquid crystal display device are sequentially made to be in the select state, and the writing into the pixel capacitance is sequentially performed. As a result, an image based on the image signal DAT sent from the outside is displayed on the display portion 600 (see FIG. 2).

2.3 Effects

Similarly to the first embodiment, in the present embodiment as well, achieved is the gate driver 400 able to quickly change the voltage of the scanning signal to the desired level at the end of each horizontal scan period, regardless of the length of the term of use of the device. Moreover, according to the present embodiment, since the gate load is driven by the high level DC power supply voltage VDD, the capacity required to be driven by the gate clock signal GCKin is reduced. As a result, the amount of power consumption is reduced in comparison with the first embodiment.

2.4 Modification Example

Figure 18:
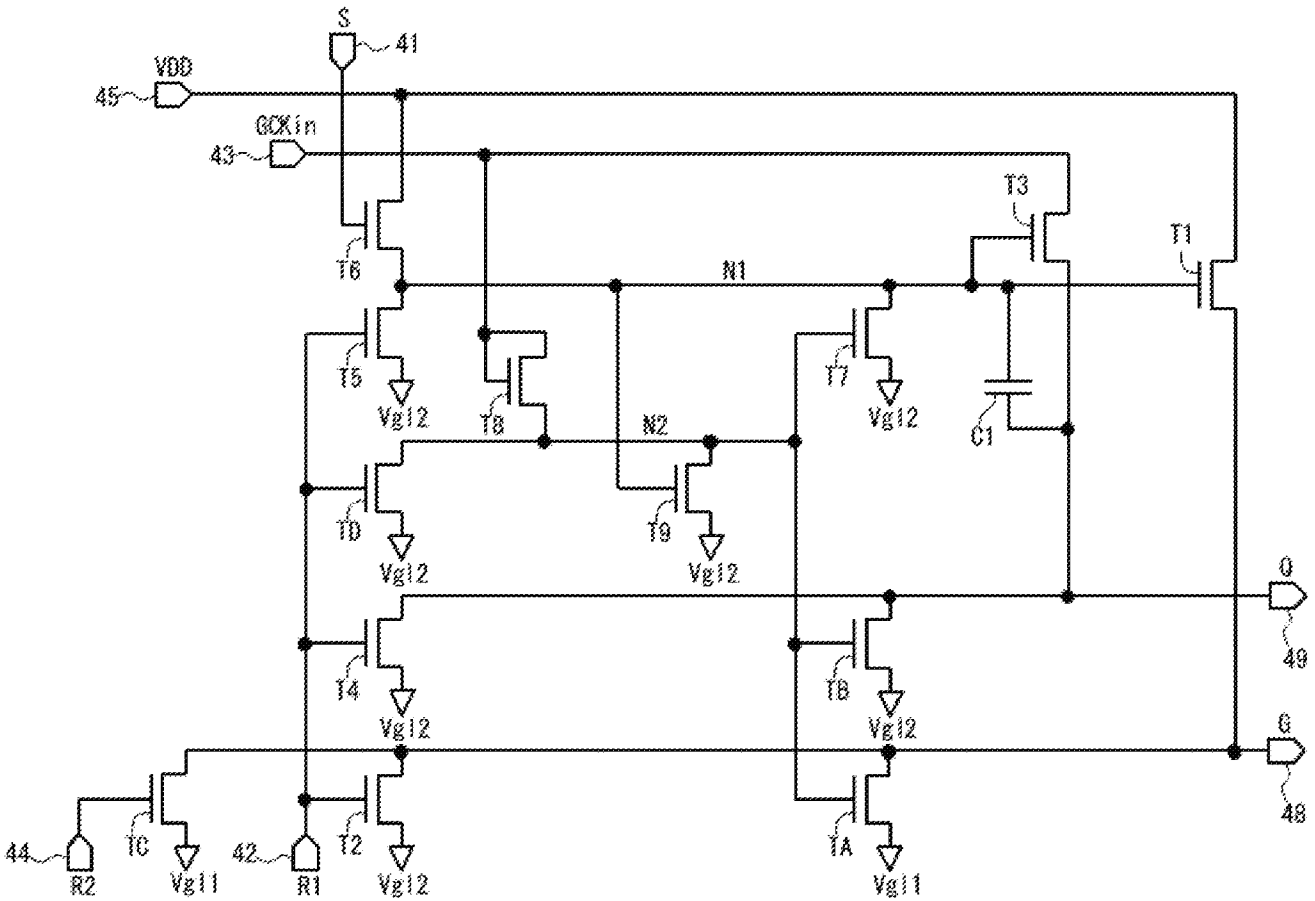
FIG. 18 is a circuit diagram illustrating a configuration of a unit circuit configuration of one stage of a shift register) in a modification example of the second embodiment.

A modification example of the second embodiment will be described below. FIG. 18 is a circuit diagram illustrating a configuration of a unit circuit 4 (configuration of one stage of a shift register 410) in the present modification example. In the present modification example, in the unit circuit 4, a thin film transistor TD is provided in addition to the constitution elements of the second embodiment discussed above. Regarding the thin film transistor TD, a gate terminal is connected to the input terminal 42, a drain terminal is connected to the second node N2, and a source terminal is connected to the input terminal for the second gate low voltage Vgl2. The thin film transistor TD changes the potential of the second node N2 toward the second low level when the first reset signal R1 is at the high level.

According to the present modification example, the unit circuit 4 is provided with the thin film transistor TD, in addition to the thin film transistor T9, as a transistor for setting the potential of the second node N2 to the second low level. Here, in a case where the potential of the second node N2 is unstable when the first reset signal R1 changes from the second low level to the high level, the state of the thin film transistor TA becomes unstable, so that there arises a risk that a flow-through current is generated between the thin film transistor T2 and the thin film transistor TA. In this regard, according to the present modification example, the potential of the second node N2 is reliably maintained at the second low level during the period (the period from the time point t23 to the time point t24 in FIG. 17) in which the first reset signal R1 is at the high level. Therefore, the generation of the flow-through current between the thin film transistor T2 and the thin film transistor TA is suppressed.

3. Other Matters

Figure 19:
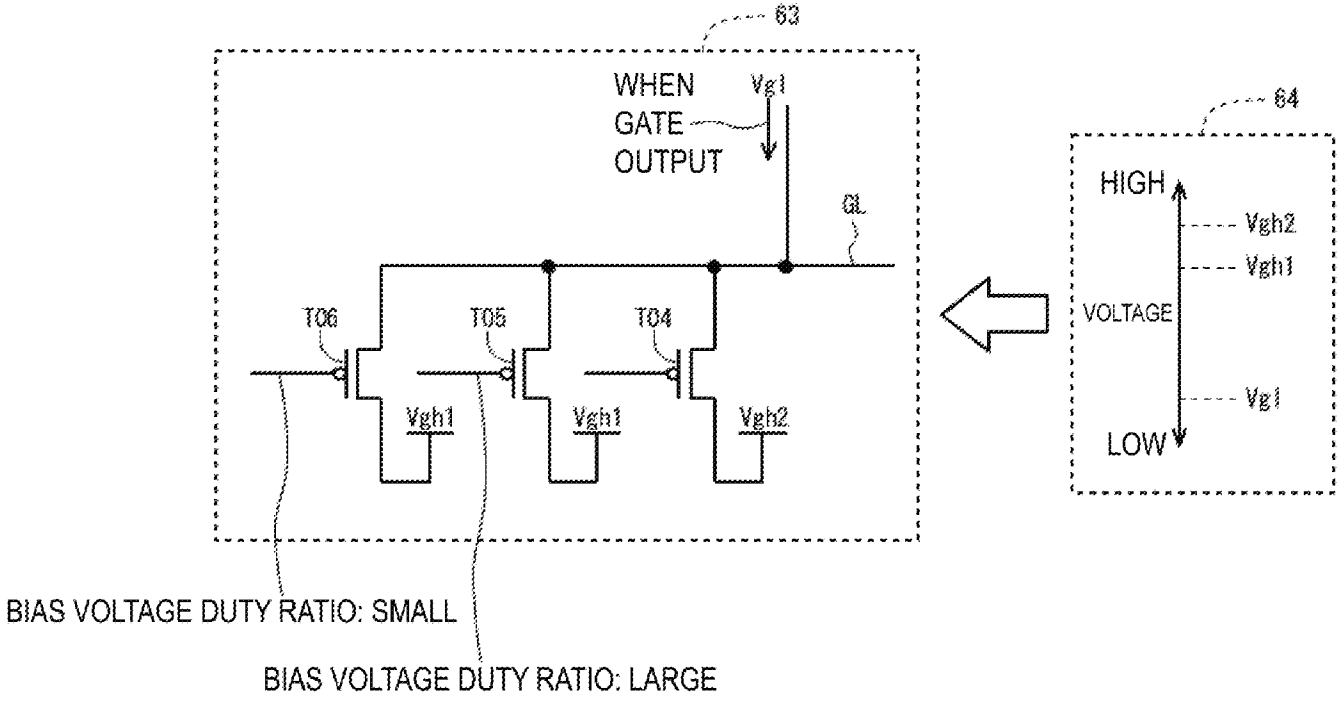
FIG. 19 is a diagram for describing a case where a p-channel thin film transistor is used.
Figure 20:
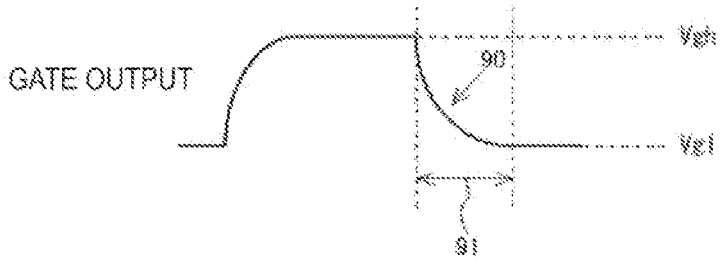
FIG. 20 is a diagram for describing a conventional technique.
Figure 21:
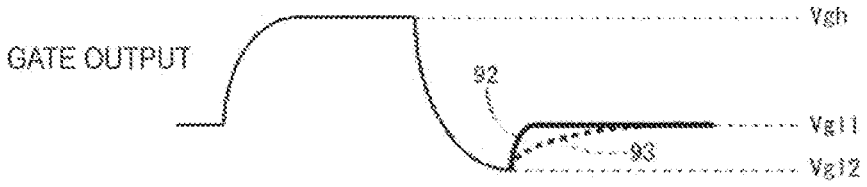
FIG. 21 is a diagram for describing a conventional technique.

In the above-described embodiments (including the modification examples), re-channel thin film transistors are employed. However, the thin film transistors are not limited thereto, and p-channel thin film transistors may be employed (see FIG. 19). In this regard, in a case where p-channel thin film transistors are employed, the polarities of the voltages are all reversed in the embodiments described above. In this case, a unit circuit includes, as constituent elements associated with raising the gate output, a gate output raising transistor T04, a gate output stabilizing transistor T05, and a gate output reset transistor T06 (see the inside of dotted lines denoted by a reference symbol 63 in FIG. 19) corresponding to the gate output lowering transistor T01, the gate output stabilizing transistor T02, and the gate output reset transistor T03 in FIG. 1, respectively. Any of the source terminals of the gate output raising transistor T04, the gate output stabilizing transistor T05, and the gate output reset transistor T06 is connected to a gate bus line GL. Further, as high level DC power supply voltages for controlling actions of the gate driver, there are prepared a first gate high voltage Vgh1 with a voltage level having been used for bringing a pixel TFT to an off state (bringing the gate bus line GL to a non-select state) and a second gate high voltage Vgh2 with a voltage level higher than the first gate high voltage Vgh1 (see the inside of dotted lines denoted by a reference symbol 64 in FIG. 19). Then, the drain terminal of the gate output stabilizing transistor T05 and the drain terminal of the gate output reset transistor T06 are supplied with the first gate high voltage Vgh1, and the drain terminal of the gate output raising transistor T04 is supplied with the second gate high voltage Vgh2. Note that the duty ratio of a bias voltage applied to the gate terminal of the gate output stabilizing transistor T05 is large, but the duty ratio of a bias voltage applied to the gate terminal of the gate output reset transistor T06 is small. In the above-described configuration, when the gate output is raised, the gate output raising transistor T04 is first set to the on state, and thereafter the gate output stabilizing transistor T05 and the gate output reset transistor T06 are brought to the on state. With this, at the time of raising the gate output, the voltage of the scanning signal once rises up to the voltage level of the second gate high voltage Vgl2 and thereafter changes to the first gate high voltage Vgh1. As described above, even in the case where p-channel thin film transistors are employed, similar effects to those of the above-described embodiments (including the modification examples) may be obtained.

Furthermore, regardless of the types of the thin film transistors used, the scanning signal line drive circuit including a shift register constituted of a plurality of unit circuits may be configured as follows. Each unit circuit is supplied at least with a first non-select level voltage and a second non-select voltage as non-select level voltages each having a voltage level for bringing a scanning signal line to a non-select state. Each unit circuit includes a first output node configured to output a first output signal to be supplied to the corresponding scanning signal line; a first output node reset transistor having a control terminal, a first conduction terminal connected to the first output node, and a second conduction terminal to be supplied with the first non-select level voltage; and a non-select control transistor having a control terminal, a first conduction terminal connected to the first output node, and a second conduction terminal to be supplied with the second non-select level voltage. Note that the control terminal of the first output node reset transistor is supplied with the first output signal or a signal having a waveform equivalent to that of the first output signal outputted from a first output node of the unit circuit in a subsequent stage. The plurality of unit circuits sequentially output, as the first output signal, a select level voltage having a voltage level for bringing the scanning signal line to the select state from the first output node. Here, a difference between the voltage level of the select level voltage and the voltage level of the second non-select level voltage is made greater than a difference between the voltage level of the select level voltage and the voltage level of the first non-select level voltage. Further, in each unit circuit, then the corresponding scanning signal line is changed from the select state to the non-select state, the non-select control transistor is made to be in an on state and thereafter the first output node reset transistor is made to be in the on state.

In the configuration illustrated in FIG. 1 (the configuration in which n-channel thin film transistors are used), the voltage level denoted by the reference symbol Vgh corresponds to the voltage level of the select level voltage, the voltage level denoted by the reference symbol Vgl1 corresponds to the voltage level of the first non-select level voltage, and the voltage level denoted by the reference symbol Vgl2 corresponds to the voltage level of the second non-select level voltage. Further, in the configuration illustrated in FIG. 19 (the configuration in which p-channel thin film transistors are used), the voltage level denoted by the reference symbol Vgl corresponds to the voltage level of the select level voltage, the voltage level denoted by the reference symbol Vgh1 corresponds to the voltage level the first non-select level voltage, and the voltage level denoted by the reference symbol Vgh2 corresponds to the voltage level of the second non-select level voltage.

Note that, it is appropriate to use an oxide semiconductor TFT (for example, IGZO-TFT) as a thin film transistor of the circuit constituting the liquid crystal display device according to the above embodiments (including the modification examples) because it exhibits effects of a power consumption reduction, a circuit area reduction, and the like.

The present invention has been described in detail thus far, but the above description is exemplary in all respects and is not limiting. A large number of other changes, modifications, and the like may be conceived without departing from the scope of the present invention.

The invention claimed is:

1. A scanning signal line drive circuit configured to drive a plurality of scanning signal lines disposed in a display portion of a display device, the circuit comprising:

a shift register comprising of a plurality of unit circuits configured to act based on a plurality of clock signals, wherein each of the plurality of unit circuits is supplied at least with a first non-select level voltage and a second non-select level voltage as non-select level voltages having a voltage level for bringing a scanning signal line to a non-select state, each unit circuit includes, a first output node configured to output a first output signal to be supplied to a corresponding scanning signal line, a first output node reset transistor having a control terminal to be supplied with the first output signal or a signal having a waveform equivalent to a waveform of the first output signal outputted from a first output node of a unit circuit in a subsequent stage, a first conduction terminal connected to the first output node, and a second conduction terminal to be supplied with the first non-select level voltage, and a non-select control transistor having a control terminal, a first conduction terminal connected to the first output node, and a second conduction terminal to be supplied with the second non-select level voltage, the plurality of unit circuits sequentially output, as the first output signal, a select level voltage having a voltage level for bringing the scanning signal line to a select state from the first output node, a difference between the voltage level of the select level voltage and the voltage level of the second non-select level voltage is greater than a difference between the voltage level of the select level voltage and the voltage level of the first non-select level voltage, in each unit circuit, at a time of changing the corresponding scanning signal line from the select state to the non-select state, the non-select control transistor is placed in an on state and then the first output node reset transistor is placed in the on state, wherein each unit circuit further includes a second output node configured to output a second output signal, for controlling action of another unit circuit, having a waveform equivalent to a waveform of the first output signal, each unit circuit is supplied with the second output signal outputted from a second output node of a unit circuit of the plurality of unit circuits positioned backward by P stages, as a first reset signal, each unit circuit is supplied with the second output signal outputted from a second output node of a unit circuit of the plurality of unit circuits positioned backward by Q stages, as a second reset signal, the Q is greater than the P, the first reset signal is supplied to the control terminal of the non-select control transistor, and the second reset signal is supplied to the control terminal of the first output node reset transistor.

2. The scanning signal line drive circuit according to claim 1, wherein each unit circuit is supplied with the second output signal outputted from a second output node of a unit circuit of the plurality of unit circuits in a preceding stage, as a set signal, and each unit circuit further includes;

a select control transistor having a control terminal, a first conduction terminal to be supplied with the select level voltage continuously or every predetermined period, and a second conduction terminal connected to the first output node, a first node connected to the control terminal of the select control transistor, a first node turn-on transistor for changing a potential of the first node toward an on level based on the set signal, and a first node turn-off transistor for changing the potential of the first node toward an off level based on the first reset signal.

3. The scanning signal line drive circuit according to claim 2, wherein each unit circuit further includes an output control transistor having a control terminal connected to the first node, a first conduction terminal to be supplied with one of the plurality of clock signals, and a second conduction terminal connected to the second output node, the first conduction terminal of the select control transistor is supplied with an identical clock signal to the clock signal supplied to the first conduction terminal of the output control transistor among the plurality of clock signals, and a voltage level of the plurality of clock signals varies between the voltage level of the select level voltage and the voltage level of the non-select level voltage.

4. The scanning signal line drive circuit according to claim 2, wherein a DC voltage is supplied as the select level voltage to the first conduction terminal of the select control transistor.

5. The scanning signal line drive circuit according to claim 2, wherein each unit circuit further includes, an output control transistor having a control terminal connected to the first node, a first conduction terminal to be supplied with one of the plurality of clock signals, and a second conduction terminal connected to the second output node, a non-output control transistor having a control terminal to be supplied with the first reset signal, a first conduction terminal connected to the second output node, and a second conduction terminal to be supplied with the non-select level voltage, a first node stabilizing transistor having a control terminal, a first conduction terminal connected to the first node, and a second conduction terminal to be supplied with the non-select level voltage, a second node connected to the control terminal of the first node stabilizing transistor, a second node turn-on transistor for maintaining a potential of the second node at an on level during a period in which a potential of the first node has to be maintained at an off level, a second node turn-off transistor having a control terminal connected to the first node, a first conduction terminal connected to the second node, and a second conduction terminal to be supplied with the non-select level voltage, a second output node stabilizing transistor having a control terminal connected to the second node, a first conduction terminal connected to the second output node, and a second conduction terminal to be supplied with the non-select level voltage, and a first output node stabilizing transistor having a control terminal connected to the second node, a first conduction terminal connected to the first output node, and a second conduction terminal to be supplied with the first non-select level voltage, and the first node turn-off transistor includes a control terminal to be supplied with the first reset signal, a first conduction terminal connected to the first node, and a second conduction terminal to be supplied with the non-select level voltage.

6. A display device comprising the scanning signal line drive circuit according to claim 1.

7. A scanning signal line drive circuit configured to drive a plurality of scanning signal lines disposed in a display portion of a display device, the circuit comprising:

a shift register comprising of a plurality of unit circuits configured to act based on a plurality of clock signals, wherein each of the plurality of unit circuits is supplied at least with a first non-select level voltage and a second non-select level voltage as non-select level voltages having a voltage level for bringing a scanning signal line to a non-select state, each unit circuit includes, a first output node configured to output a first output signal to be supplied to a corresponding scanning signal line, a first output node reset transistor having a control terminal to be supplied with the first output signal or a signal having a waveform equivalent to a waveform of the first output signal outputted from a first output node of a unit circuit in a subsequent stage, a first conduction terminal connected to the first output node, and a second conduction terminal to be supplied with the first non-select level voltage, and a non-select control transistor having a control terminal, a first conduction terminal connected to the first output node, and a second conduction terminal to be supplied with the second non-select level voltage, the plurality of unit circuits sequentially output, as the first output signal, a select level voltage having a voltage level for bringing the scanning signal line to a select state from the first output node, a difference between the voltage level of the select level voltage and the voltage level of the second non-select level voltage is greater than a difference between the voltage level of the select level voltage and the voltage level of the first non-select level voltage, in each unit circuit, at a time of changing the corresponding scanning signal line from the select state to the non-select state, the non-select control transistor is placed in an on state and then the first output node reset transistor is placed in the on state, wherein each unit circuit further includes, a select control transistor having a control terminal, a first conduction terminal to be supplied with the select level voltage continuously or every predetermined period, and a second conduction terminal connected to the first output node, a first node connected to the control terminal of the select control transistor, a first node stabilizing transistor having a control terminal, a first conduction terminal connected to the first node, and a second conduction terminal to be supplied with the non-select level voltage, a second node connected to the control terminal of the first node stabilizing transistor, a second node turn-on transistor for maintaining a potential of the second node at an on level during a period in which a potential of the first node has to be maintained at an off level, and a first output node stabilizing transistor having a control terminal connected to the second node, a first conduction terminal connected to the first output node, and a second conduction terminal to be supplied with the first non-select level voltage.

8. A display device comprising the scanning signal line drive circuit according to claim 7.

9. A scanning signal line drive circuit configured to drive a plurality of scanning signal lines disposed in a display portion of a display device, the circuit comprising:

a shift register comprising of a plurality of unit circuits configured to act based on a plurality of clock signals, wherein each of the plurality of unit circuits is supplied at least with a first non-select level voltage and a second non-select level voltage as non-select level voltages having a voltage level for bringing a scanning signal line to a non-select state, each unit circuit includes, a first output node configured to output a first output signal to be supplied to a corresponding scanning signal line, a first output node reset transistor having a control terminal to be supplied with the first output signal or a signal having a waveform equivalent to a waveform of the first output signal outputted from a first output node of a unit circuit in a subsequent stage, a first conduction terminal connected to the first output node, and a second conduction terminal to be supplied with the first non-select level voltage, and a non-select control transistor having a control terminal, a first conduction terminal connected to the first output node, and a second conduction terminal to be supplied with the second non-select level voltage, the plurality of unit circuits sequentially output, as the first output signal, a select level voltage having a voltage level for bringing the scanning signal line to a select state from the first output node, a difference between the voltage level of the select level voltage and the voltage level of the second non-select level voltage is greater than a difference between the voltage level of the select level voltage and the voltage level of the first non-select level voltage, in each unit circuit, at a time of changing the corresponding scanning signal line from the select state to the non-select state, the non-select control transistor is placed in an on state and then the first output node reset transistor is placed in the on state, wherein the first output node reset transistor and the non-select control transistor are n-channel thin film transistors, the voltage level of the select level voltage is higher than the voltage level of the first non-select level voltage, and the voltage level of the first non-select level voltage is higher than the voltage level of the second non-select level voltage.

10. A display device comprising the scanning signal line drive circuit according to claim 9.

* * * * *